US006808420B2

(12) United States Patent
Whiteman, Jr. et al.

(10) Patent No.: US 6,808,420 B2
(45) Date of Patent: Oct. 26, 2004

(54) HIGH SPEED ELECTRICAL CONNECTOR

(75) Inventors: Robert Neil Whiteman, Jr., Middletown, PA (US); Wayne Samuel Davis, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/255,769

(22) Filed: Sep. 25, 2002

(65) Prior Publication Data

US 2003/0220021 A1 Nov. 27, 2003

Related U.S. Application Data

(60) Provisional application No. 60/382,886, filed on May 22, 2002.

(51) Int. Cl.[7] ..... H01R 13/648

(52) U.S. Cl. ..... 439/608; 439/701; 439/108; 439/751; 439/943; 439/79

(58) Field of Search ..... 439/608, 701, 439/108, 751, 943, 79

(56) References Cited

U.S. PATENT DOCUMENTS 3,777,093 A * 12/1973 Sterns et al. ..... 200/181
5,286,212 A * 2/1994 Broeksteeg ..... 439/108
5,403,206 A * 4/1995 McNamara et al. ..... 439/608
6,146,157 A * 11/2000 Lenoir et al. ..... 439/101
6,206,729 B1 * 3/2001 Bradley et al. ..... 439/608
6,231,397 B1 * 5/2001 de la Borbolla et al. ... 439/676
6,347,962 B1 2/2002 Kline ..... 439/608
6,350,134 B1 2/2002 Fogg et al. ..... 439/79
6,461,202 B2 * 10/2002 Kline ..... 439/701
6,652,318 B1 11/2003 Winings et al. ..... 439/608

FOREIGN PATENT DOCUMENTS

EP 0 959 535 A1 11/1999 ..... H01R/23/70
EP 1 107 387 A1 6/2001 ..... H01R/13/658

* cited by examiner

*Primary Examiner*—Dean A. Reichard
*Assistant Examiner*—Anton Harris

(57) ABSTRACT

An electrical connector comprising a connector housing holding signal contacts and ground contacts in an array organized into rows. Each row includes pairs of the signal contacts and some of the ground contacts arranged in a pattern, wherein adjacent first and second rows have respective different first and second patterns.

21 Claims, 22 Drawing Sheets

HIGH SPEED ELECTRICAL CONNECTOR

RELATED APPLICATIONS

This application relates to and claims priority benefits from U.S. Provisional Patent Application No. 60/382,886 entitled "High Speed Electrical Connector," filed May 22, 2002, which is incorporated by reference herein in its entirety.

BACKGROUND OF THE INVENTION

The present invention generally relates to an electrical connector for transmitting high speed electrical signals in differential pair applications.

Many board-to-board connector systems have been proposed for interconnecting circuit boards that include traces arranged to convey differential pairs of signals. The differential pairs include complimentary signals such that if one signal in a differential pair switches from 0 V to 1 V, the other signal in the differential pair switches from 1 V to 0 V. Each connector exhibits a characteristic impedance.

In that past, fluctuations in impedance exhibited by a connector did not degrade signal performance by an appreciable amount when signal/data transmission rates were relatively low (e.g., less than 1 GHz). However, newer systems have been proposed to transmit data signals at speeds approaching and exceeding 2 GHz. In these high speed data transmission systems, even small impedance fluctuations may pose significant problems, such as signal loss, interference, noise, jitter and the like within each connector.

Further, each trace of the circuit board is attached to a unique signal pin of the connector. Within the connector, signal pins of separate different differential pairs may become electromagnetically coupled to one another. When signal pins of different differential pairs become coupled with one another, the signal pins exhibit cross talk. Cross talk increases the interference, noise, and jitter within the circuit board, connector and system. Increasing the distance between signal pins of separate differential pairs typically decreases the effects of interference, noise and jitter. Increasing the distance between differential pairs typically requires a larger connector. However, electrical and electronic applications today require a large number of differential pairs to be packaged in a small space. Many systems require as small a connector as possible to make efficient use of internal space.

Thus, a need remains for an electrical connector that exhibits improved signal characteristics in terms of impedance, interference, noise and jitter. Further, a need exists for an electrical connector that may accommodate a high number of signal contacts, while reducing interference, noise and jitter among the signal contacts.

BRIEF SUMMARY OF THE INVENTION

Certain embodiments of the present invention provide an electrical connector comprising a connector, signal contacts and ground contacts. The connector comprises a connector housing having a mating face configured to join a mating electrical connector. The connector housing includes channels extending therethrough The signal contacts and ground contacts are held in the channels in an array organized into rows. Each row includes ground contacts separated by signal contact pairs. The ground contacts and signal contact pairs are ordered in different first and second patterns, respectively, in adjacent first and second rows in the array. The first and second rows are staggered relative to one another so that the signal contact pairs in the first and second rows are separated from one another by the ground contacts. A first signal contact pair in the first row is shielded from a second signal contact pair in the first row by a first ground contact. The first row is staggered with respect to the second row so that the first signal contact pair is shielded from a third signal contact pair in the second row by the first ground contact.

Figure 1:
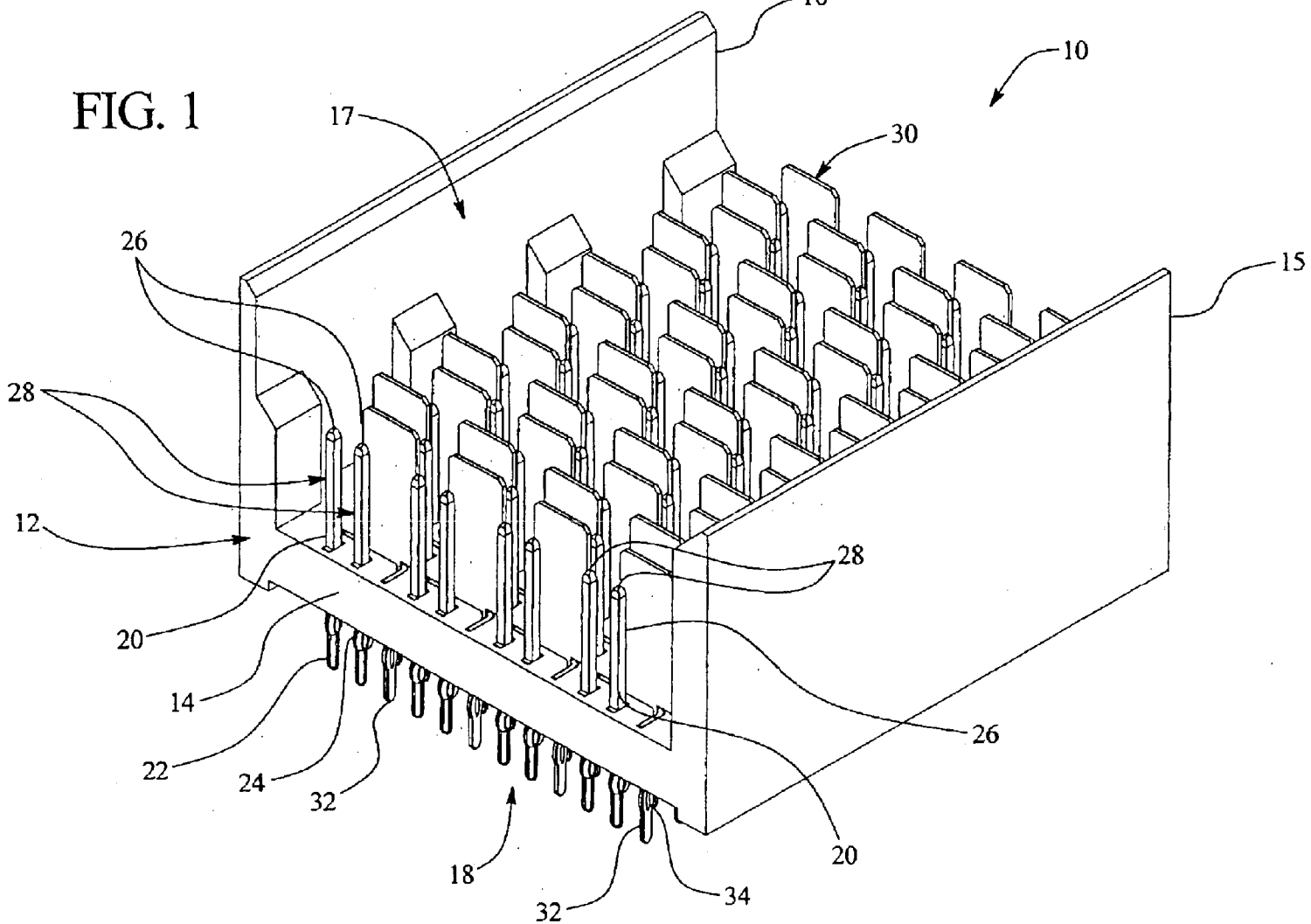
FIG. 1 illustrates an isometric view of a header connector according to an embodiment of the present invention.
Figure 2:
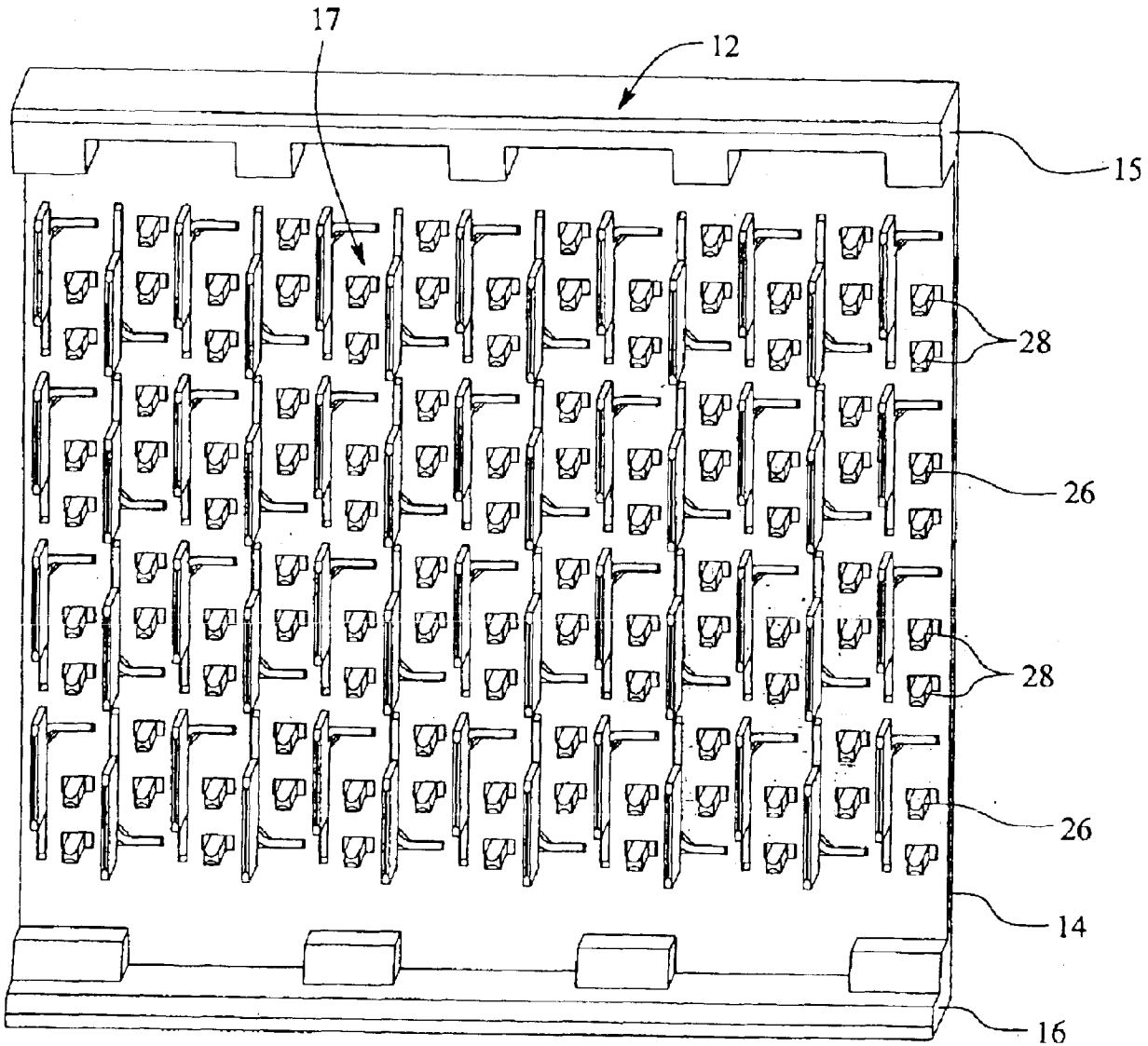
FIG. 2 illustrates another isometric view of the header connector from a different angle according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

As shown in FIGS. 1–4, a header connector 10 comprises a dielectric housing 12 including a main wall 14, an upper shroud 15 and a lower shroud 16. The header connector 10 further comprises a plurality of signal contacts 20 and ground contacts 30 that extend through and are secured in the main wall 14. The header connector 10 includes a mating face 17 that interfaces with a mating face 57 of a corresponding receptacle connector 50, shown in FIG. 6. The header connector 10 also includes a board-mounting face 18 that interfaces with a circuit board (not shown) on which the header connector 10 is mounted. The header connector 10 mates with the receptacle connector 50 such that the circuit board on which the header connector 10 mounts is oriented perpendicular to the circuit board, backplane, or other such structure, on which the receptacle connector 50 is mounted or otherwise positioned.

Figure 6:
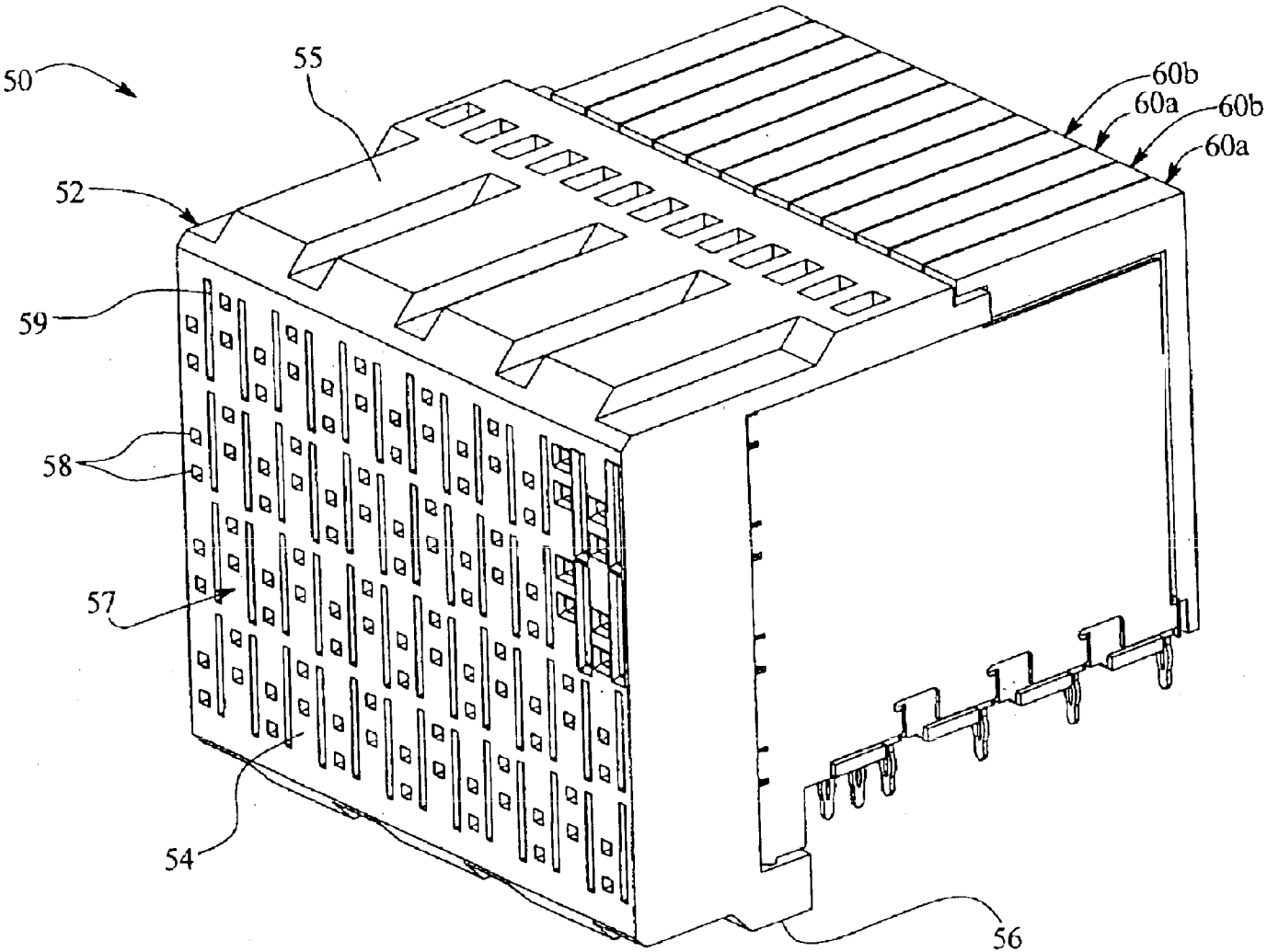
FIG. 6 illustrates an isometric view of a receptacle connector according to an embodiment of the present invention.
Figure 11:
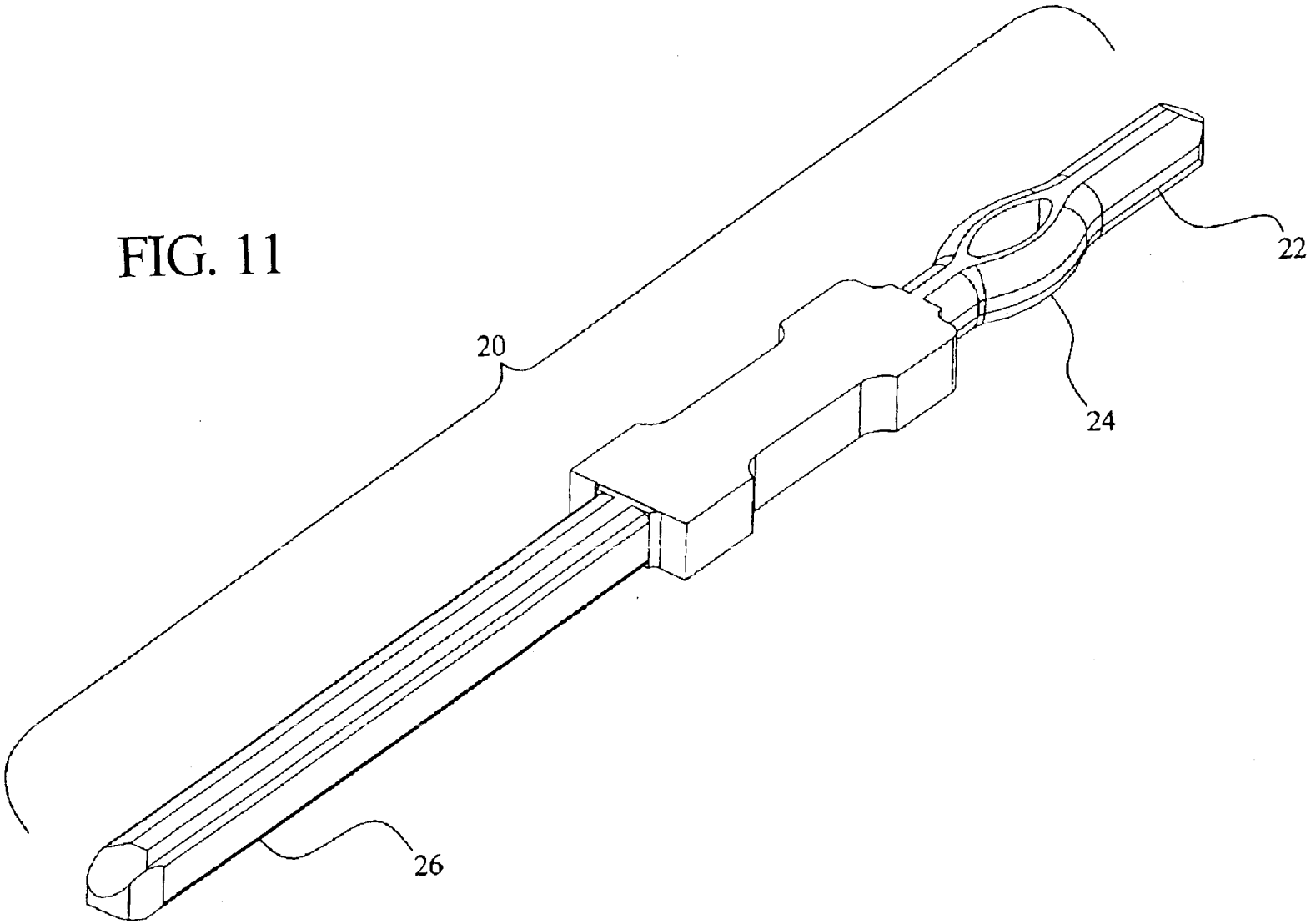
FIG. 11 illustrates an isometric view of a signal contact according to an embodiment of the present invention.

FIG. 11 illustrates an exemplary signal contact 20, which includes a tail or lead 22 with a compliant section 24 that is configured for press-fit insertion into a plated signal through-hole in the circuit board (not shown.). Each of the signal contacts 20 also has a post 26 that is matable with a corresponding contact in the receptacle connector 50. The posts 26 are insertable into respective holes 58 in the mating face 57 of the receptacle connector 50 (FIG. 6).

Figure 5:
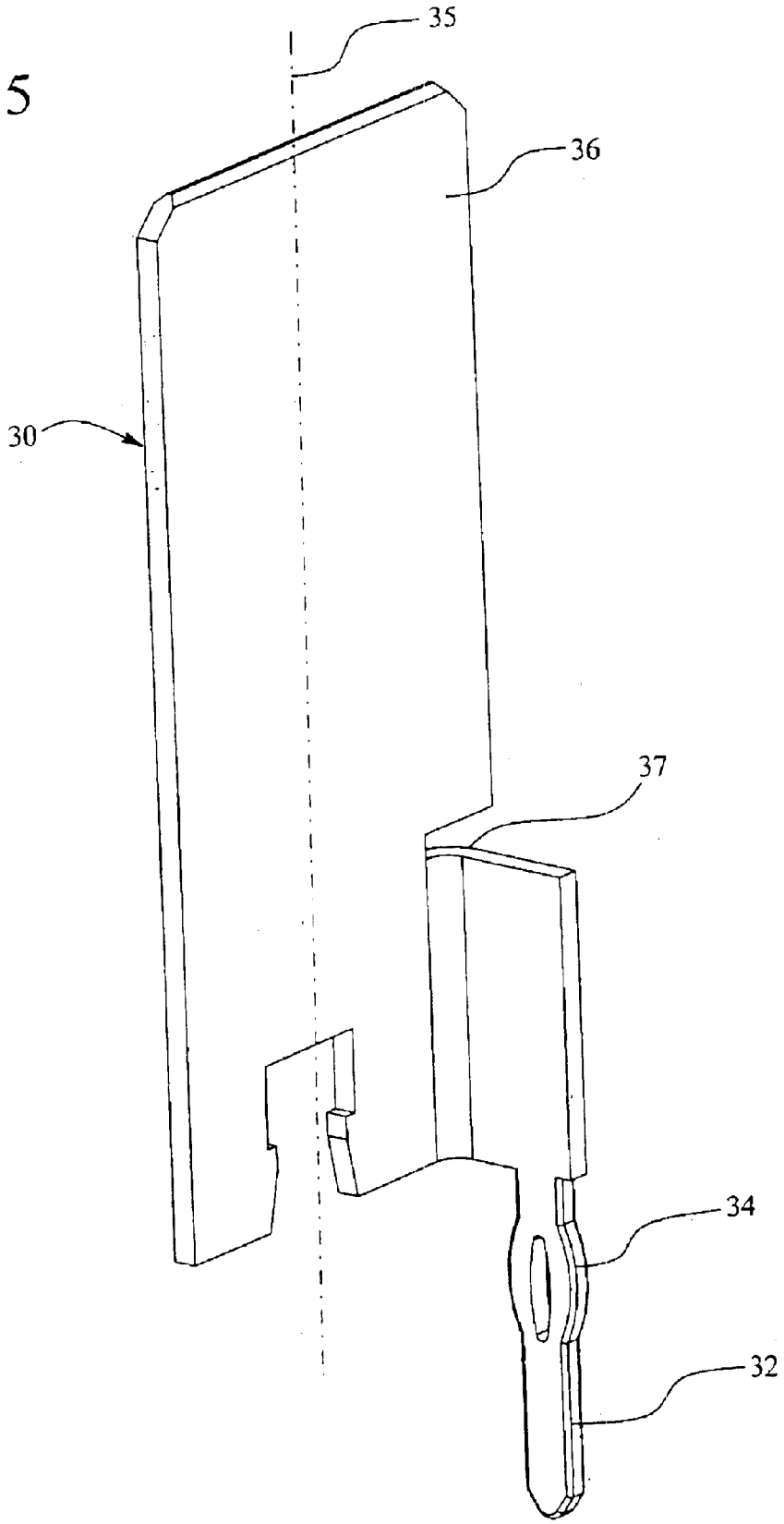
FIG. 5 illustrates an isometric view of a ground contact used in the header connector according to an embodiment of the present invention.

FIG. 5 illustrates an exemplary ground contact 30, which includes a tail or lead 32 with a compliant section 34 that is configured for press-fit insertion into a plated ground through-hole in the circuit board, and a blade 36 that is engagable with a corresponding ground shield in the receptacle connector 50. The tail 32 and compliant section 34 are oriented at an angle to the plane of the blade 36 by a bend portion 37. The bend portion 37 is provided along one side edge of the blade 36, such that the tail 32 is offset from a central longitudinal axis 35 of the blade 36. The blades 36 are insertable into respective slots 59 in the mating face of the receptacle connector 50 (FIG. 6). For the sake of simplicity, only one ground contact 30 is shown in FIG. 5. It is to be understood, however, that analogous ground contacts are used with the header connector 10. For example, the ground contacts 30 in adjacent rows (such as rows 41 in FIG. 3) are not merely inverted. Rather, ground contacts 30 in one row 41 may be formed as mirror images of the ground contacts 30 in an adjacent row 41. Preferably, two sets of ground contacts 30 are formed such that one set is a mirror image of the other. However, all of the ground contacts 30 share the same basic features.

Figure 3:
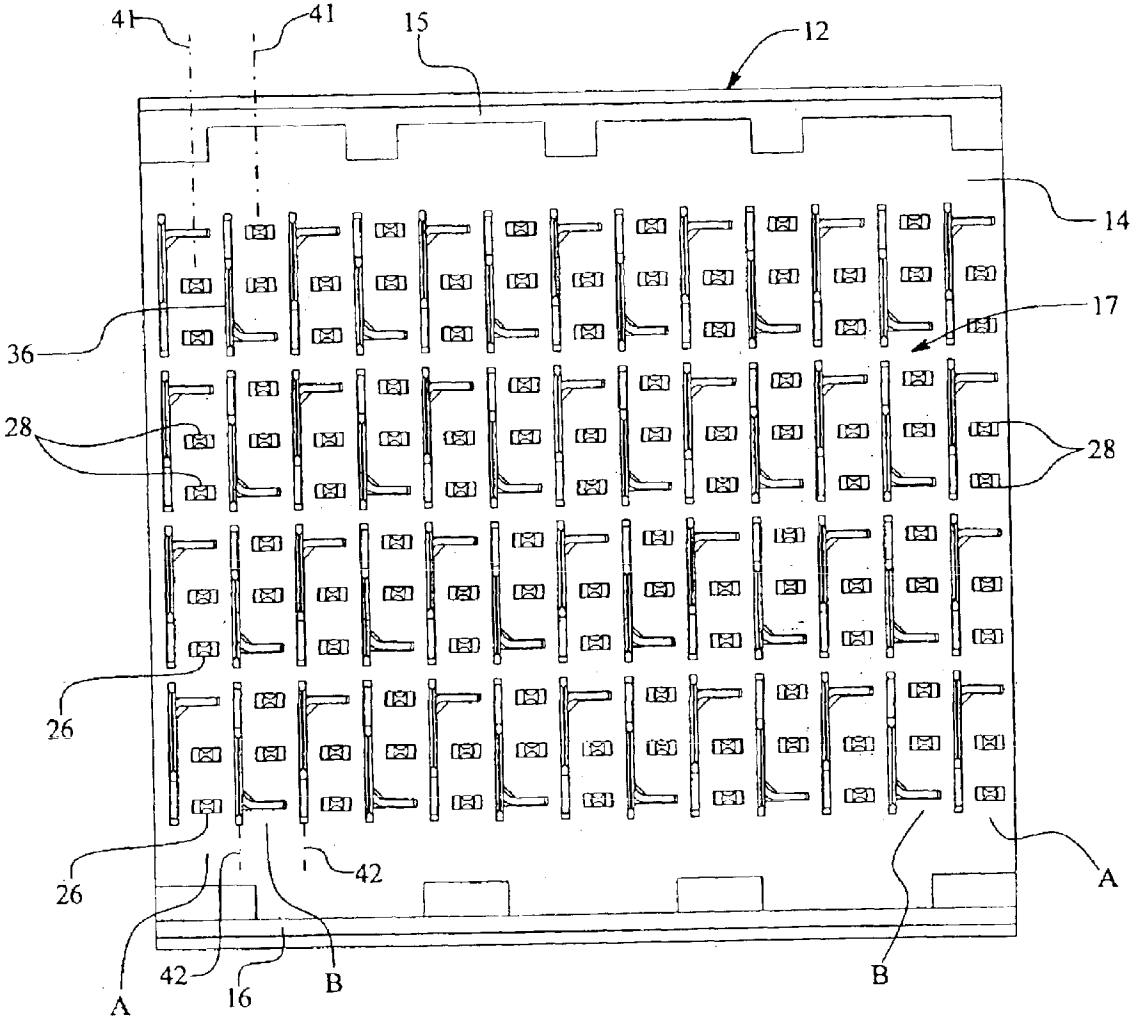
FIG. 3 illustrates a top plan view showing a mating face of the header connector according to an embodiment of the present invention.

With respect to FIG. 3, the signal and ground contacts 20 and 30 are arranged in an array in the header connector 10. The array includes groups with each group comprising two signal contacts 20 and one ground contact 30. The two signal contacts 20 in each group are associated as a signal contact pair 28, which serves to transmit a pair of differential electrical signals through the header connector 10. One ground contact 30 is associated with each signal contact pair 28. More particularly, along the mating face 17 as shown in FIG. 3, the signal contact posts 26 are arranged in parallel rows 41 which are separated by rows 42 of the ground contact blades 36. That is, adjacent rows of signal contact pairs 28 are separated by an intervening row of ground contact blades 36.

Figure 4:
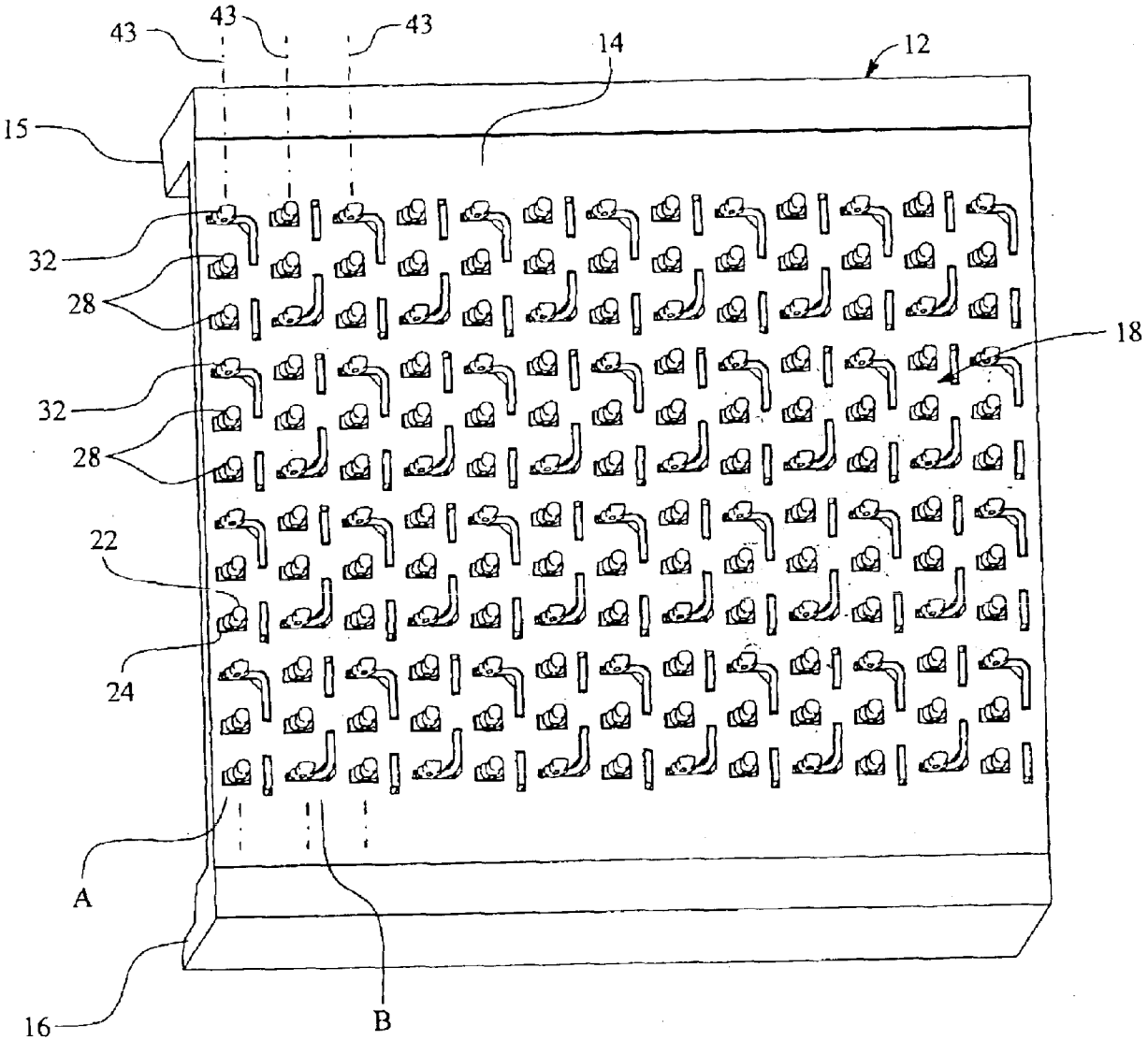
FIG. 4 illustrates a bottom view showing a mounting face of the header connector according to an embodiment of the present invention.

As shown in FIG. 4, along the board-mounting face 18, the signal contact tails 22 are arranged in parallel rows 43 that also include the ground contact tails 32 due to the ground contact tails 32 being offset from the blades 36 by the bend portions 37 of the ground contacts 30. The ground contact tails 32 intervene between the pairs of signal contact tails 22 within each row 43.

The signal contact pairs 28 in the array are staggered from row 43 to row 43. More particularly, the pattern of signal and ground contacts 20 and 30, respectively, in any one row along the board-mounting face 18 shown in FIG. 4 is reversed in the next adjacent row. That is, as shown in FIG. 4, for example, the orientation of one row 43 is opposite that of the adjacent row. The rows may be termed odd and even according to their sequence from one side of the header connector 10. All of the odd rows have one pattern of signal and ground contacts 20 and 30, respectively, and all of the even rows have another pattern that is reversed from that in the odd rows. For example, as shown in FIGS. 3 and 4, the pattern of row A is reversed from the pattern of row B. Thus, the signal contact pairs 28 in row A are staggered relative to the signal contact pairs 28 in row B. Along the mating face 17 shown in FIG. 3, the pairs of signal contact posts 26 in any one row are staggered with respect to the pairs of signal contact posts 26 in the next adjacent row. This staggered array of signal and ground contacts 20 and 30 serves to isolate each signal contact pair 28 from neighboring signal contact pairs 28, thereby reducing electrical cross-talk and improving electrical performance.

FIG. 6 illustrates the receptacle connector 50, which comprises a dielectric housing 52 having a main wall 54, an upper shroud 55 and a lower shroud 56. The receptacle connector 50 holds a plurality of contact modules 60*a*, 60*b*, shown in FIGS. 7–10. Each contact module 60*a* and 60*b* includes a dielectric molding 62*a*, 62*b* that holds signal contacts and a ground contact. The contact modules 60*a* and 60*b* are similar to each other, but each has a respective pattern of signal contacts corresponding to the pattern of signal contacts 20 in a respective one of the rows in the header connector 10.

Figure 9:
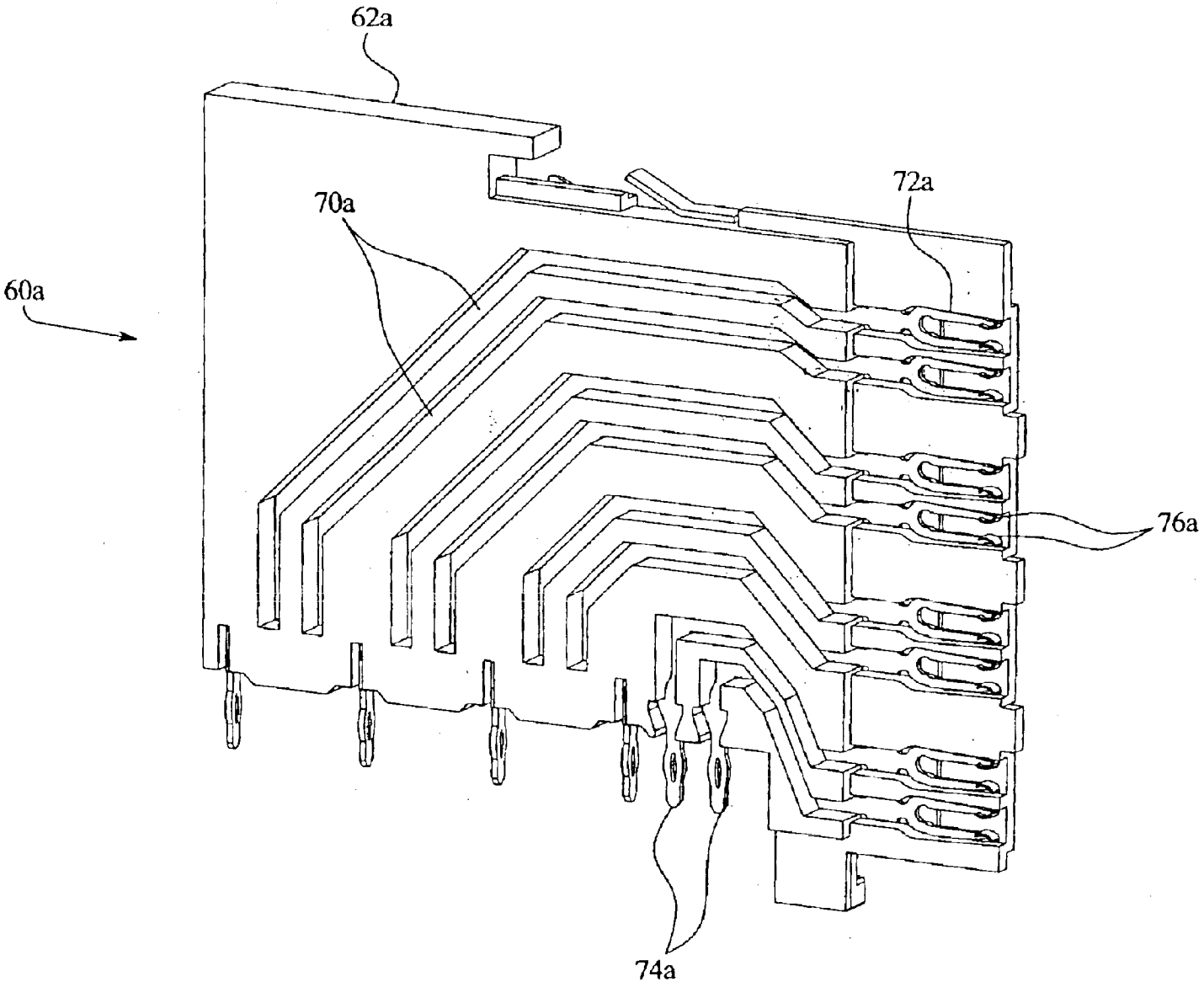
FIG. 9 shows an opposite side of the first contact module according to an embodiment of the present invention.
Figure 10:
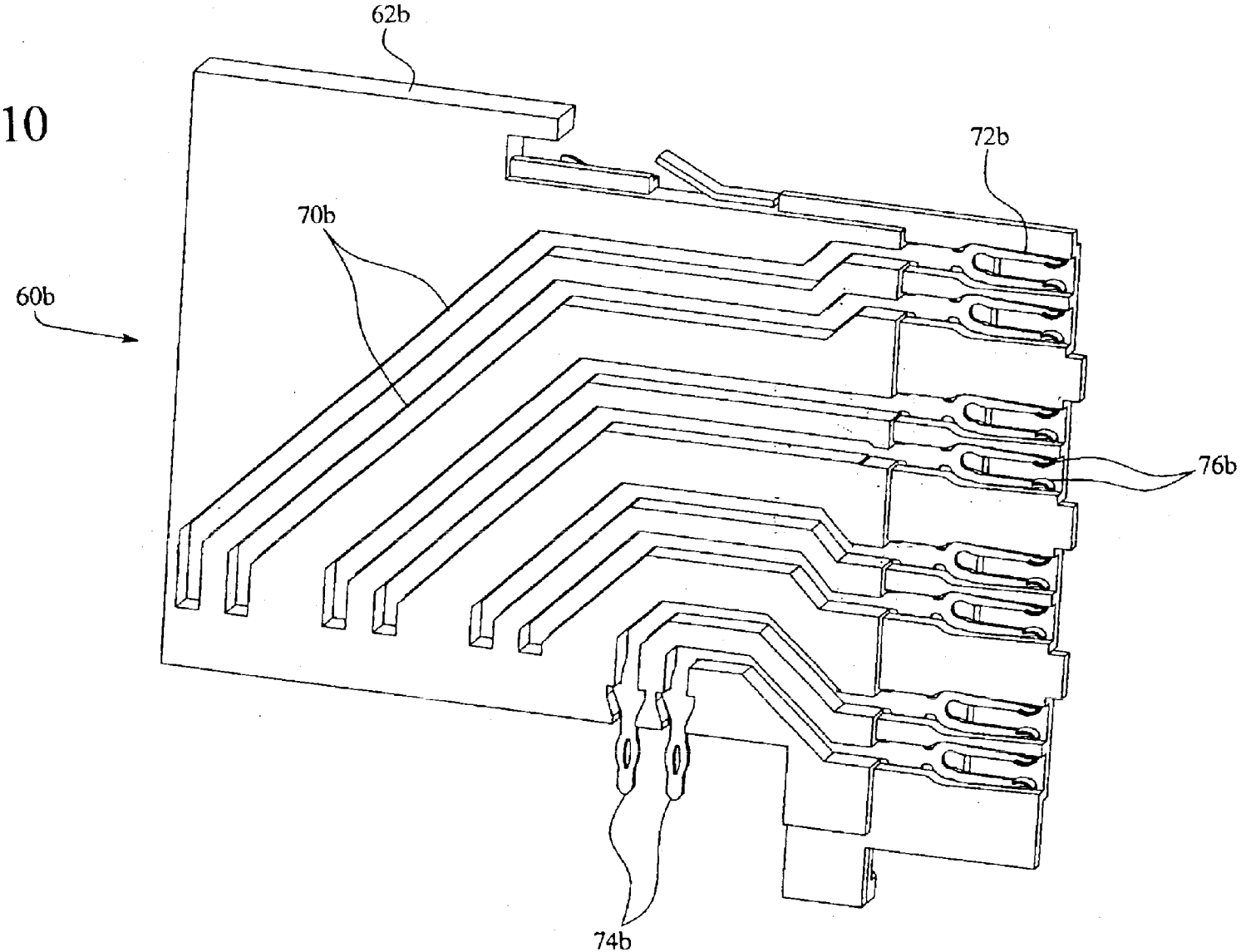
FIG. 10 shows an opposite side of the second contact module according to an embodiment of the present invention.

As shown in FIGS. 9 and 10, each of the modules 60*a*, 60*b* has a plurality of signal contacts 70*a*, 70*b* each having a receptacle section 72*a*, 72*b* at a mating end and a compliant tail section 74*a*, 74*b* at a board-mounting end (only two representative compliant sections are shown in the Figures). The receptacle section 72*a*, 72*b* comprises dual contact beams 76*a*, 76*b* that engage a corresponding signal contact post 26 that is inserted therebetween.

Figure 7:
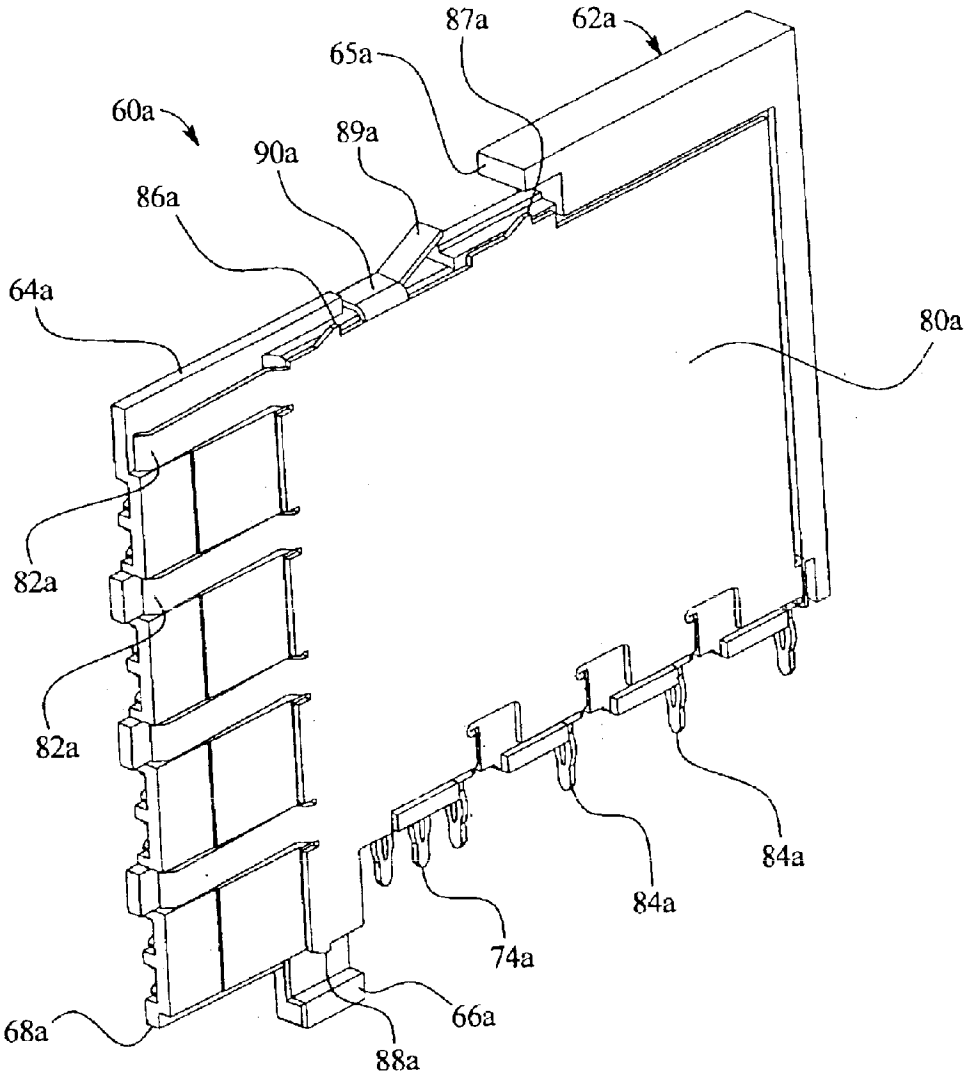
FIG. 7 illustrates an isometric view showing one side of a first contact module used in the receptacle connector according to an embodiment of the present invention.
Figure 8:
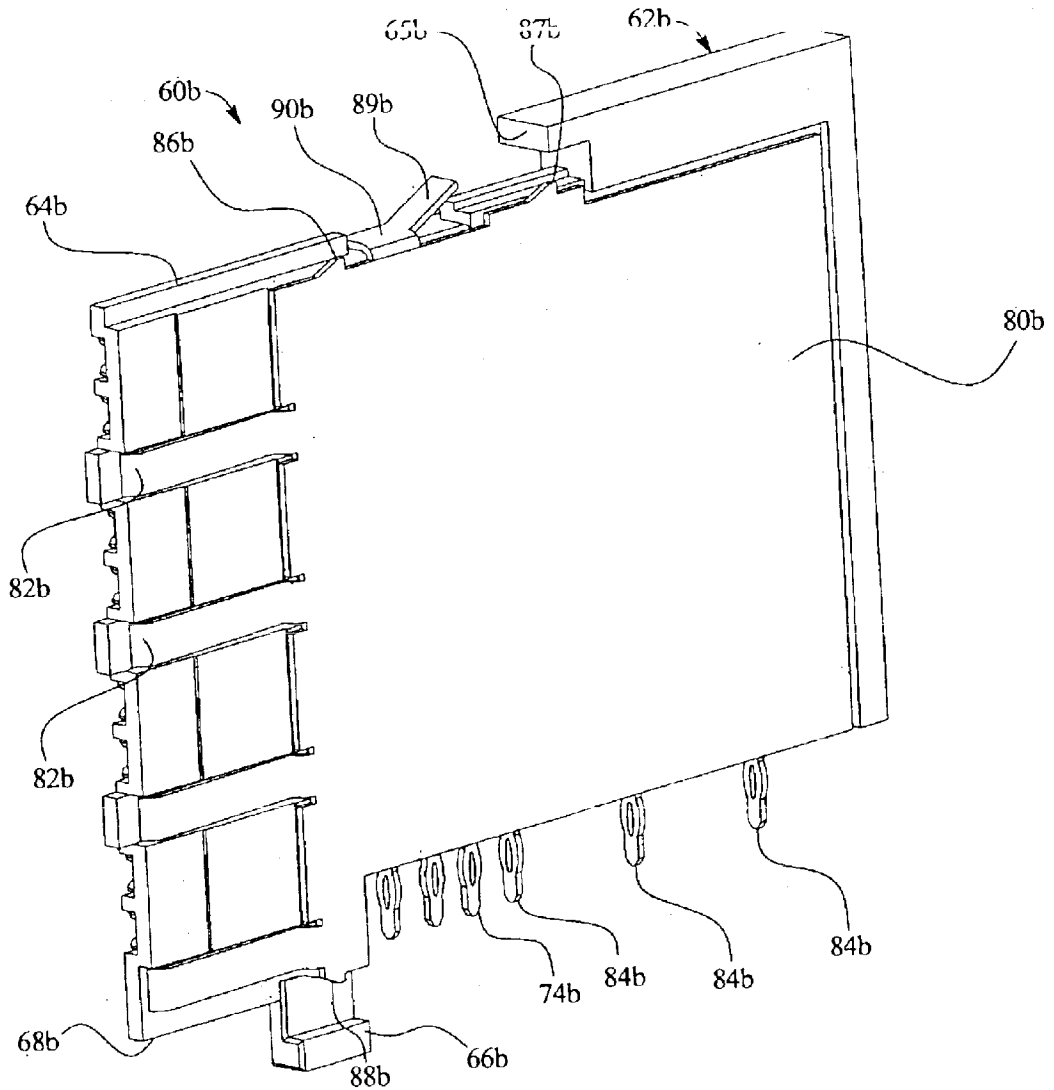
FIG. 8 illustrates an isometric view showing one side of a second contact module used in the receptacle connector according to an embodiment of the present invention.

As shown in FIGS. 7 and 8, each of the modules 60*a*, 60*b* includes a ground shield 80*a*, 80*b* with ground contact springs 82*a*, 82*b* that are engageable with corresponding ground contact blades 36 of the header connector. The ground shields 80*a*, 80*b* include compliant tail sections 84*a*, 84*b* configured to engage ground through-holes in a circuit board (not shown).

Each of the modules 60*a*, 60*b* has a beam 64*a*, 64*b* that is receivable in a track in the upper shroud, a projection 65*a*, 65*b* that overlies a support on the upper shroud, and a lug 66*a*, 66*b* that is receivable in a groove in the lower shroud. Additionally, the modules 60*a*, 60*b* have lower beams 68*a*, 68*b*, respectively, that are receivable in a track on the lower shroud. The beams 64*a*, 64*b*, 68*a*, 68*b*, the projections 65*a*, 65*b* and the lugs 66*a*, 66*b* serve to stabilize and align the module 60*a*, 60*b* in the receptacle housing 52.

Each of the ground shields 80*a*, 80*b* has a first upper barb 86*a*, 86*b*, a second upper barb 87*a*, 87*b*, and a lower barb 88*a*, 88*b*, all of which dig into the dielectric housing 52 as the modules 60*a*, 60*b* are inserted into the dielectric housing 52 to secure the modules 60*a*, 60*b* in the dielectric housing 52. Each ground shield 80*a*, 80*b* also has a resilient latch tab 89*a*, 89*b* that extends from a folded portion 90*a*, 90*b*. The latch tabs 89*a*, 89*b* engage a corresponding ledge of the dielectric housing 52 to prevent the modules 60*a*, 60*b* from backing out of the dielectric housing 52.

Figure 12:
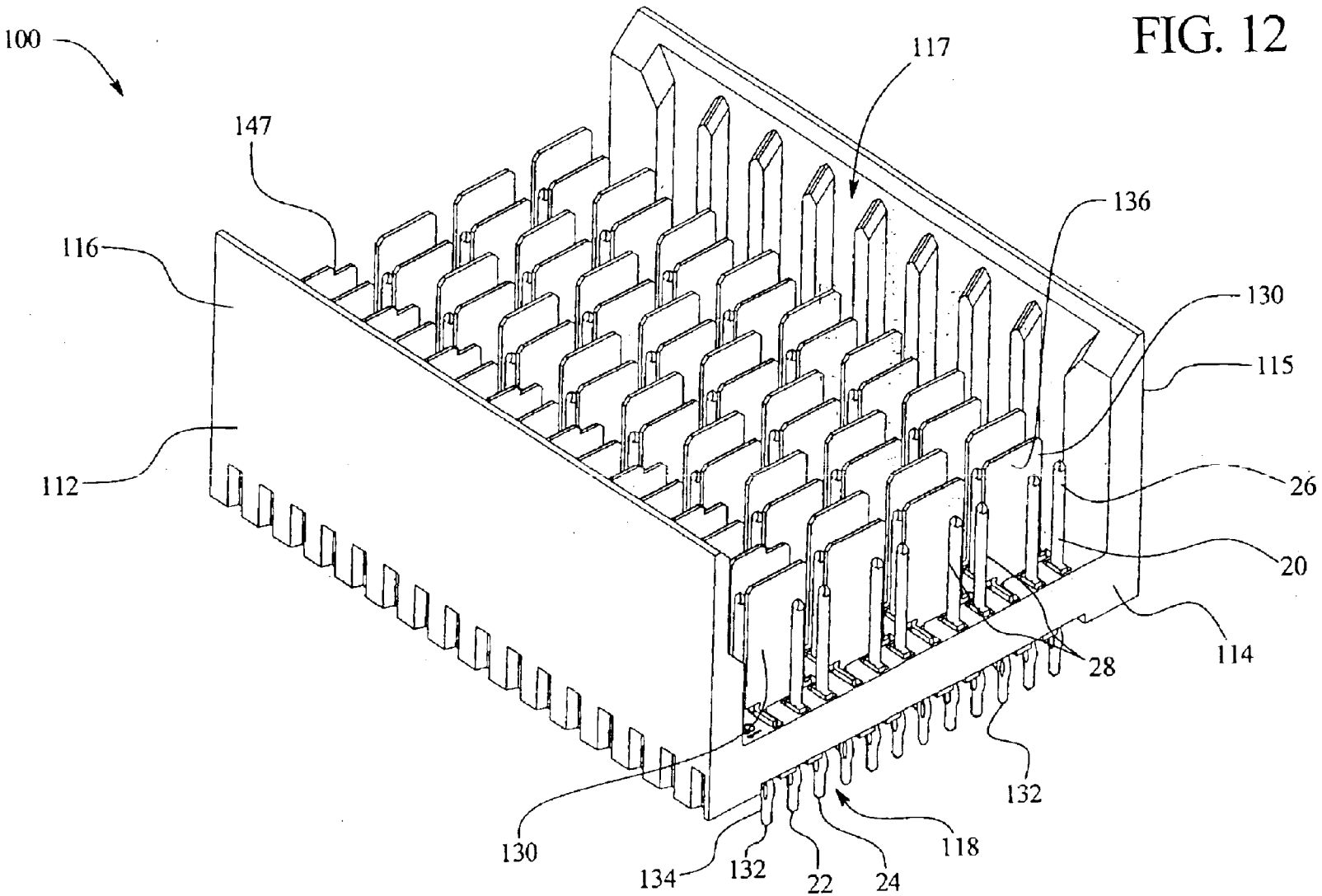
FIG. 12 illustrates an isometric view of a header connector according to an alternative embodiment of the present invention.

FIG. 12 is an isometric view of a header connector 100 according to an alternative embodiment of the present invention. The header connector 100 includes a dielectric housing 112 having a main wall 114, an upper shroud 115 and a lower shroud 116. The header connector 100 further includes a plurality of signal contacts 20 and ground contacts 130 that extend through and are secured in the main wall 114. The header connector 100 also includes a mating face 117 that interfaces with a mating face 157 of a corresponding receptacle connector 150 (shown in FIG. 15). Further, the header connector 100 includes a board-mating face 118 that interfaces with a circuit board (not shown) on which the header connector 100 is mounted. The header connector 100 mates with the receptacle connector 150 such that the circuit board to which the header connector 100 mounts is oriented perpendicular to the circuit board, backplane, or other such structure on which the receptacle connector 150 is mounted or otherwise positioned.

Figure 15:
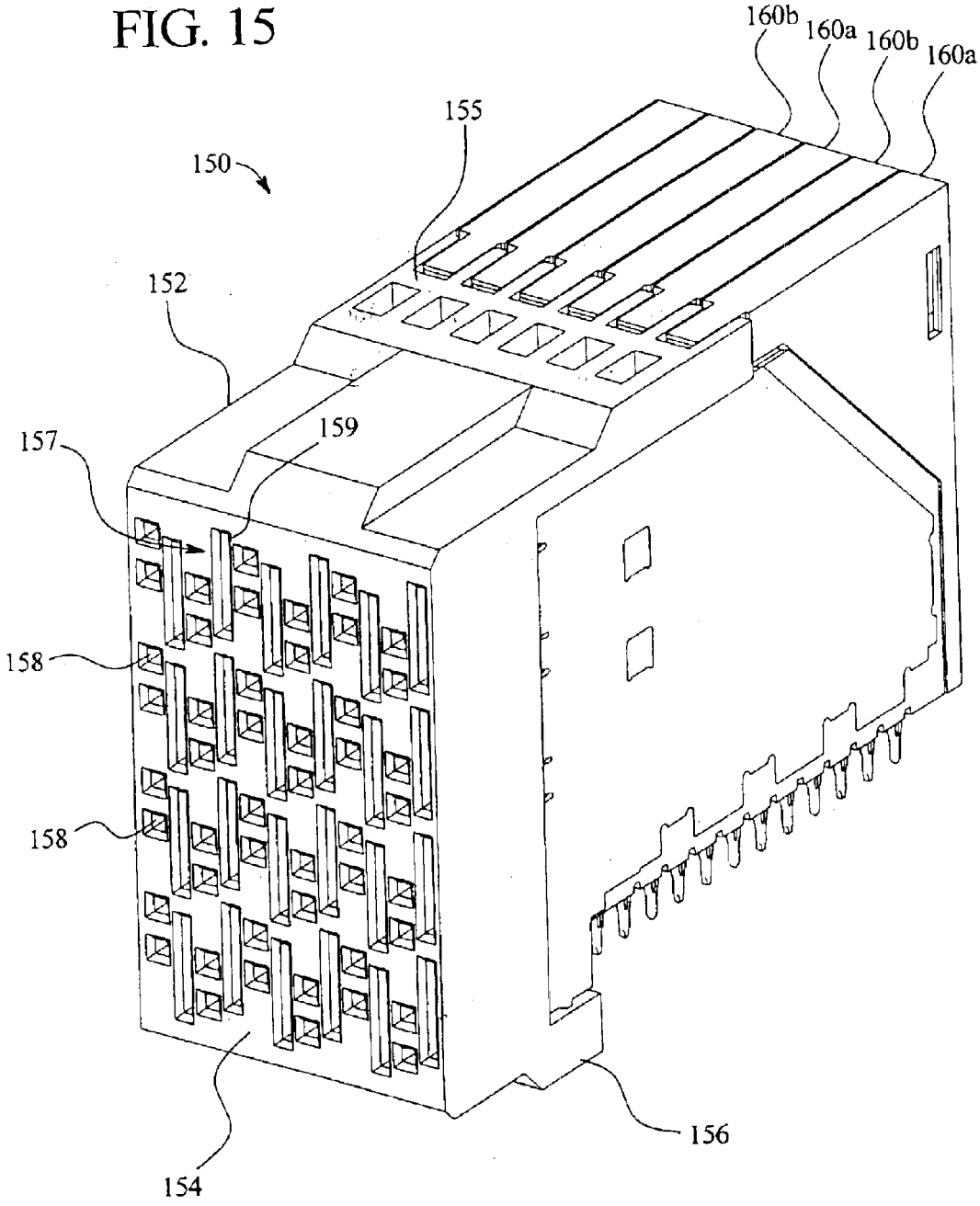
FIG. 15 illustrates an isometric view of a portion of a receptacle connector according to an alternative embodiment of the present invention.

The signal contacts 20 used with the header connector 100 are the same as those used with the header connector 10. The posts 26 of the signal contacts 20, which are matable with a corresponding contact in the receptacle connector 150, are insertable into respective holes 158 in the mating face 157 of the receptacle connector 150 (as shown in FIG. 15).

Figure 13:
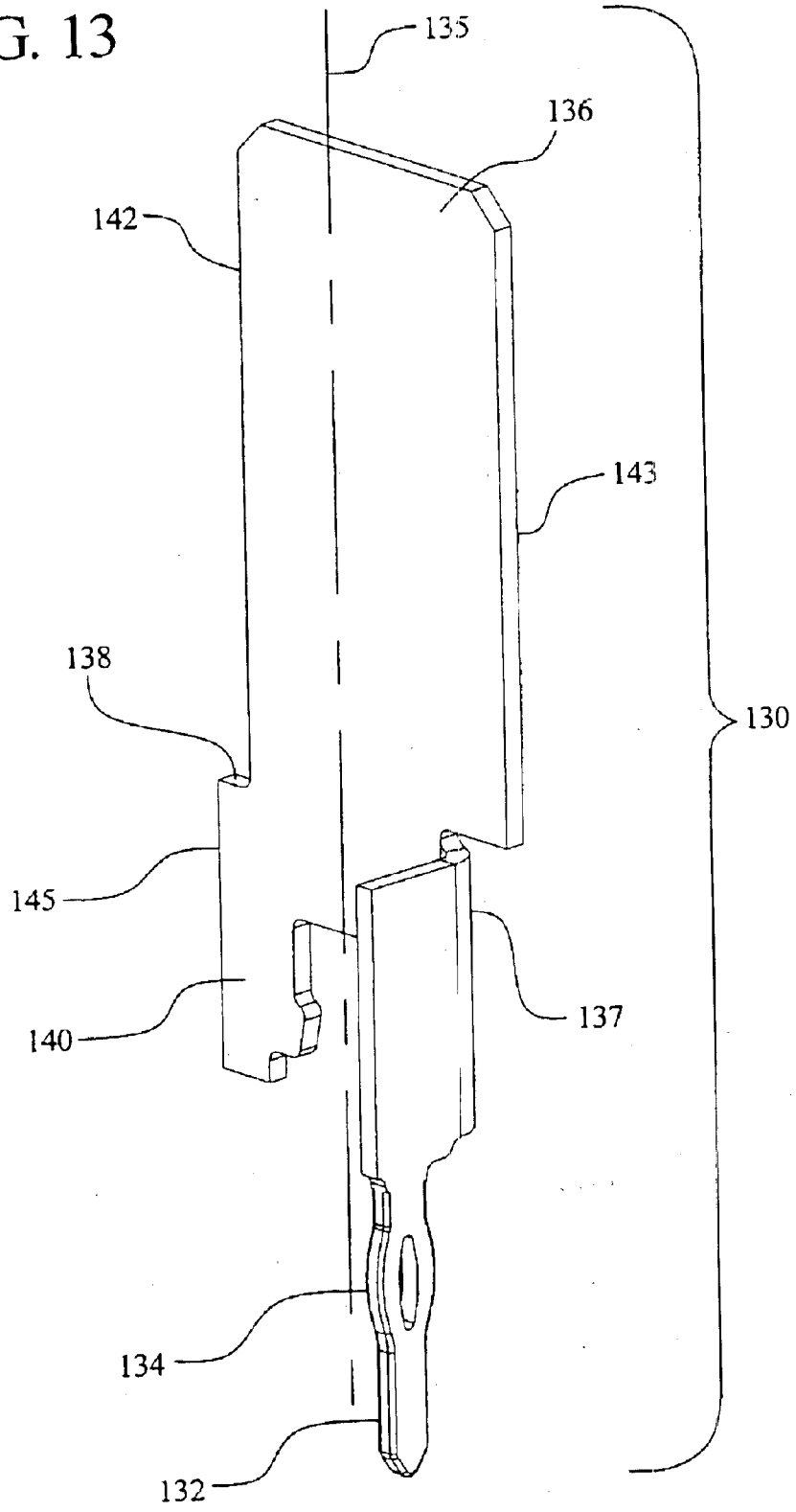
FIG. 13 illustrates an isometric view of a ground contact according to an alternative embodiment of the present invention.

FIG. 13 is an isometric view of a ground contact 130 according to an alternative embodiment of the present invention. Similar to the ground contacts 30, two sets of ground contacts 130 are formed so that one set is a mirror image of the other set. The ground contacts 130 are similar to the ground contacts 30, with some variations. Each ground contact 130 includes a tail 132 formed integrally with a compliant section 134, which in turn is formed integrally with a bend portion 137. The bend portion 137 is formed integrally with a blade 136. The tail 132 is oriented at an angle to the plane of the blade 136. The bend portion 137 is provided along one side edge of the blade 136, such that the tail 132 is offset from a central longitudinal axis 135 of the blade 136. As shown in FIG. 13, the plane of the blade 136 may be perpendicular to the plane of the tail 132 and complaint section 134.

The blade 136, which is also formed integrally with a housing retained portion 140, includes a leading edge 142 and a rear edge 143. The blade 136 is recessed from the housing retained portion 140 such that the leading edge 142 is offset from a leading edge 145 of the housing retained portion 140. Because the blade 136 is recessed from the housing retained portion 140, the main wall retained portion 140 includes an exposed upper edge 138. Due to the recessed nature of the blade 136 from the leading edge of the housing retained portion 140, the blade 136 is not as wide as the blade 36 of the ground contact 30. Additionally, as shown in FIG. 12, the ground contacts 130 may include a notched upper portion 147 to allow for clearance between internal structures when mated with the receptacle connector 150.

The signal and ground contacts 20 and 130 are arranged in an array in the header connector 100. The array includes a plurality of associated groups, each comprising two signal contacts 20 and one ground contact 130. The two signal contacts 20 in each associated group are associated as signal contact pairs 28 to transmit a pair of differential electrical signals through the header connector 100. One ground contact 130 within an associated group is associated with each signal contact pair 28.

Figure 14:
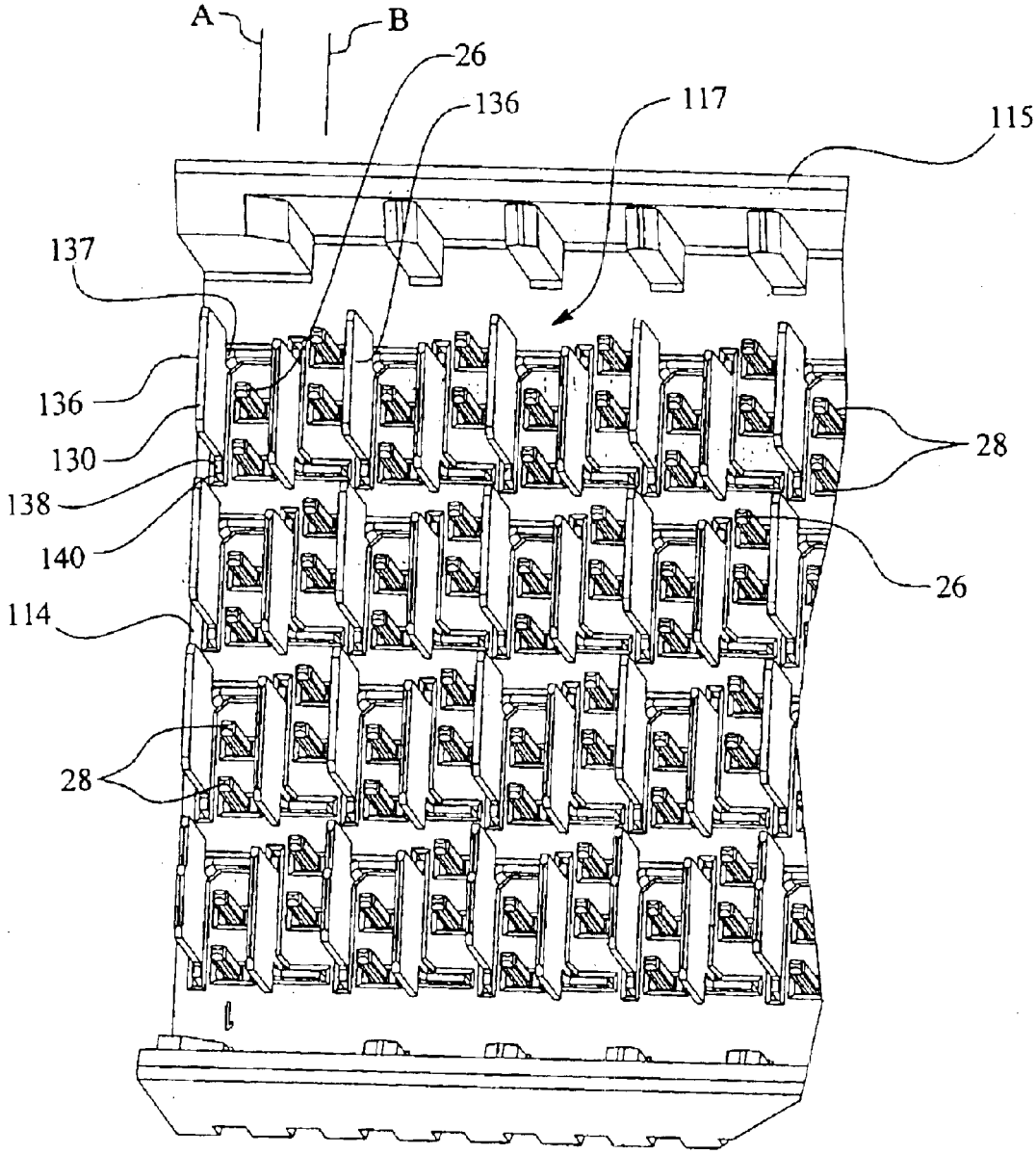
FIG. 14 illustrates an isometric view of a mating face of the header connector according to an alternative embodiment of the present invention.

FIG. 14 is an isometric view of the mating face 117 of the header connector 100 according to an alternative embodiment of the present invention. The signal contact pairs 28 are staggered relative from row to row with respect to one another. That is, the signal contact pairs 28 in row A are staggered relative to the signal contact pairs 28 is row B. Each signal contact pair 28 in one row, for example, row A, is staggered relative to a signal contact pair 28 in an adjacent row, for example, row B. Further, each signal contact pair 28 in one row, for example, row A, is shielded from a signal contact pair in an adjacent row, for example, row B, by a blade 136 of a ground contact 130. That is, an intervening row of blades 136 of ground contacts 130 is positioned between two rows of signal contact pairs 28, such as rows A and B of signal contact pairs 28. Further, the ground contact tails 132 intervene between signal contact tails 122 of signal contact pairs 28 within each row. Thus, each signal contact pair 28 is shielded from other signal contact pairs 28 by ground contacts 30.

A comparison of blades 36 and 136 (as shown, for example, in FIGS. 2 and 14, respectively) shows that the recessed nature of the blade 136 from the housing retained portion 140 exhibits a more pronounced staggered effect between ground contacts 136. Further, the recessed nature of the blade 136 requires less material for the blades 136, and also allows for increased space within the header connector 100.

FIG. 15 is an isometric view of a portion of a receptacle connector 150 according to an alternative embodiment of the present invention. The receptacle connector 150 is similar to the receptacle connector 50 (shown with respect to FIG. 6). The receptacle connector 150 includes a dielectric housing 152 having a main wall 154, an upper shroud 155 and a lower shroud 156. The receptacle connector 150 also includes the mating face 157 having a plurality of holes 158 and slots 159. The holes 158 receive and retain posts 26 of signal contacts 20, while the slots receive and retain blades 136 of ground contacts 130.

Figure 16:
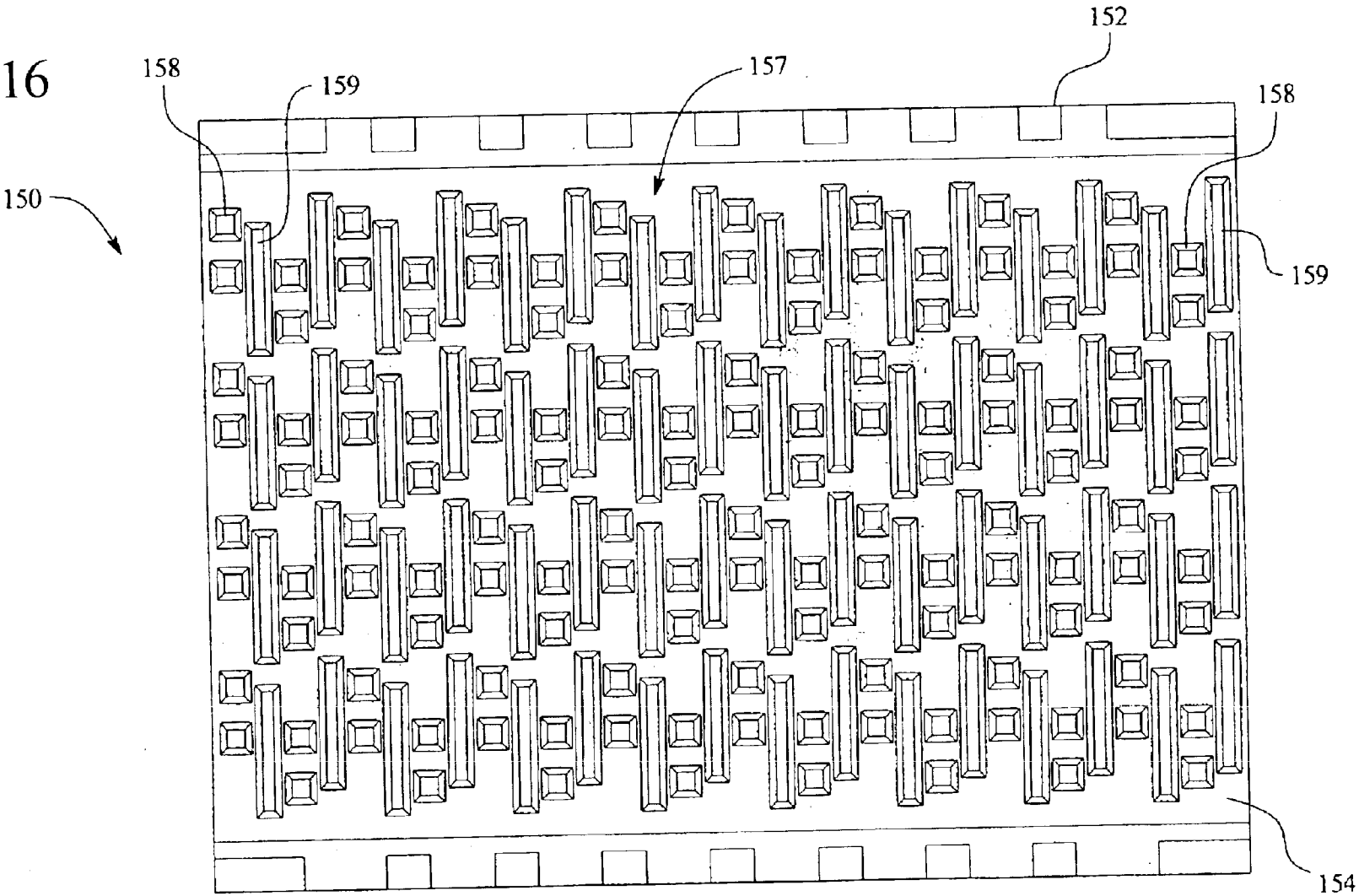
FIG. 16 illustrates a plan view of a mating face of a receptacle connector according to an alternative embodiment of the present invention.

FIG. 16 is a plan view of the mating face 157 of the receptacle connector 150 according to an alternative embodiment of the present invention. The mating face 157 of the receptacle connector 150 is configured to mate with the mating face 117 of the header connector 100. When the receptacle connector 150 is fully mated with the header connector 100, the staggered nature of the associated groups of signal contact pairs 28 and ground contacts 130 with respect to one another shields signal contact pairs 28 in one row from signal contact pairs 28 in an adjacent row.

Figure 17:
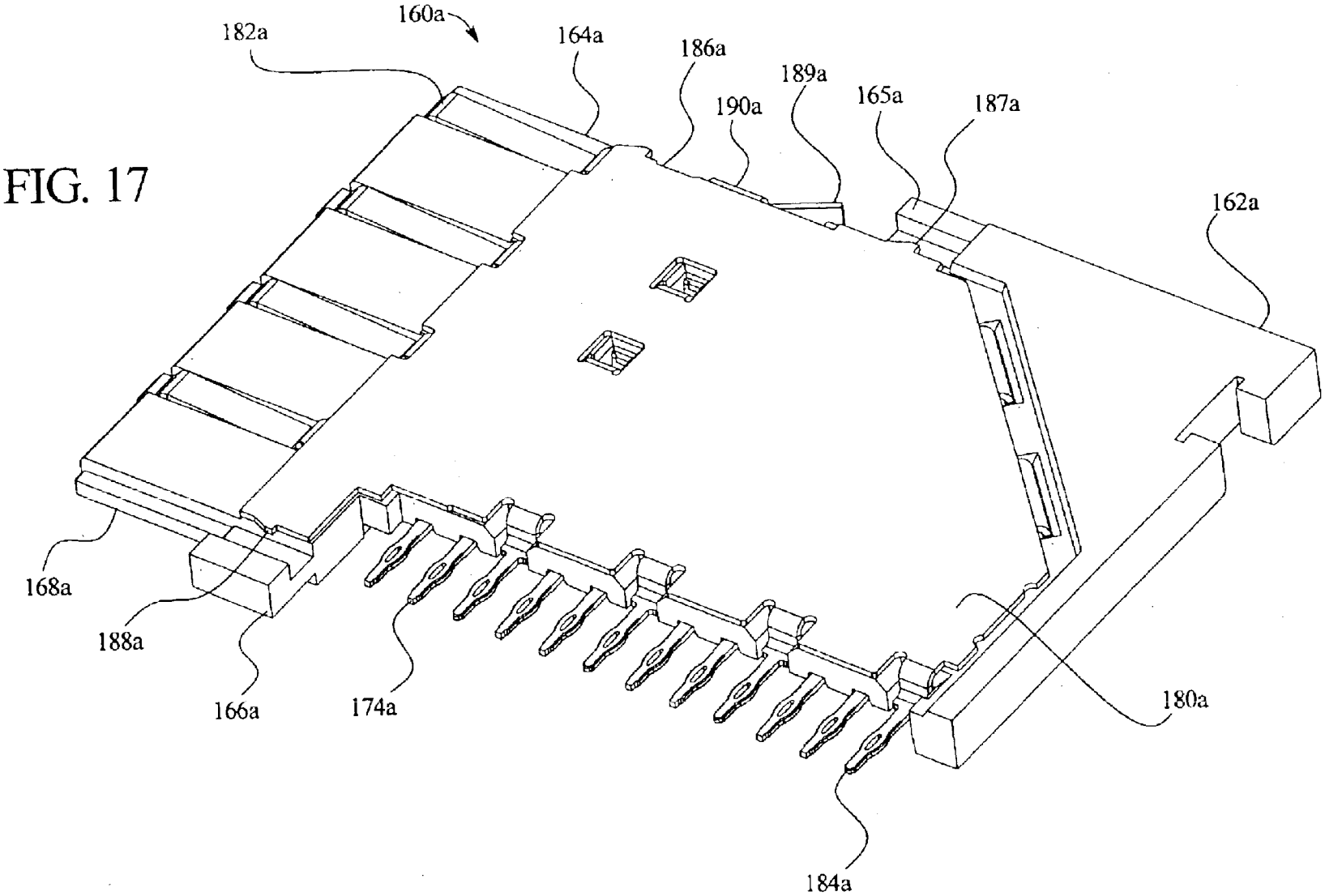
FIG. 17 illustrates an isometric view showing one side of a first contact module, which is configured to be housed in a receptacle connector, according to an alternative embodiment of the present invention.
Figure 18:
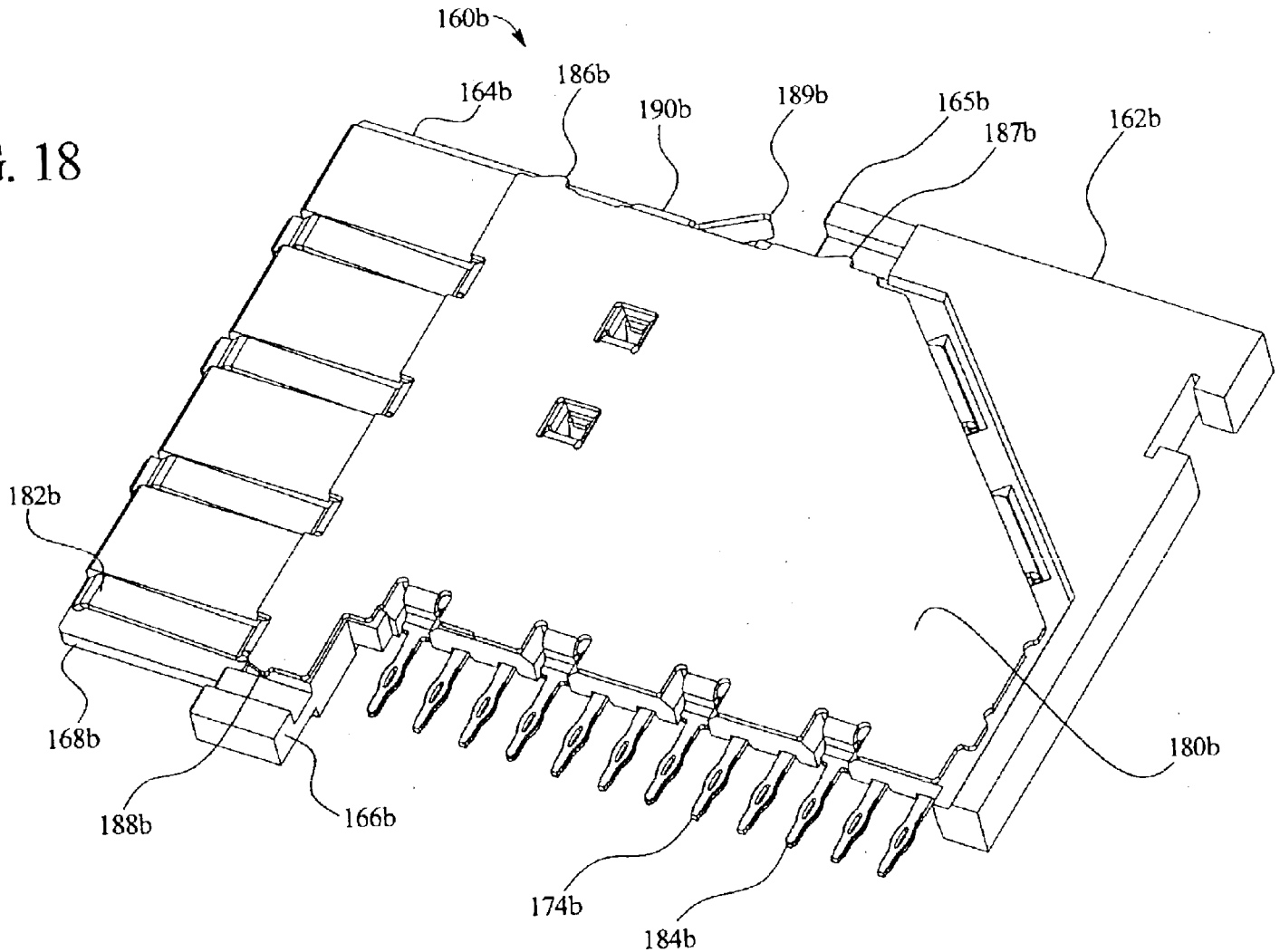
FIG. 18 illustrates an isometric view showing one side of a second contact module, which is configured to be housed in a receptacle connector, according to an alternative embodiment of the present invention.

FIG. 17 is an isometric view showing one side of a contact module 160*a*, which is configured to be housed in the receptacle connector 150, according to an alternative embodiment of the present invention. FIG. 18 is an isometric view showing one side of a contact module 160*b*, which is configured to be housed in the receptacle connector 150, according to an alternative embodiment of the present invention. The contact modules 160*a* and 160*b* are similar to each other, but each has a respective pattern of signal contacts corresponding to the pattern of signal contacts 20 in a respective one of the rows in the header connector 100.

The receptacle connector 150 holds a plurality of contact modules 160*a* and 160*b*. Each contact module 160*a*, 160*b* includes a dielectric molding 162*a*, 162*b* that holds signal contacts and a ground shield. The contact modules 160*a*, 160*b* may be assembled by inserting signal contacts 170*a*, 170*b* into the dielectric molding 162*a*, 162*b*, respectively, and mounting ground shields 180*a*, 180*b* onto the opposite sides of the dielectric moldings 162*a*, 162*b*, respectively. The ground shields 180*a*, 180*b* are mounted onto the dielectric moldings 162*a*, 162*b*, respectively, such that an interference fit exists between each ground shield 180*a*, 180*b* and its corresponding dielectric molding 162, 162*b*. Alternatively, the ground shields 180*a*, 180*b* may be snapably secured into the dielectric moldings 162*a*, 162*b*, respectively.

Figure 19:
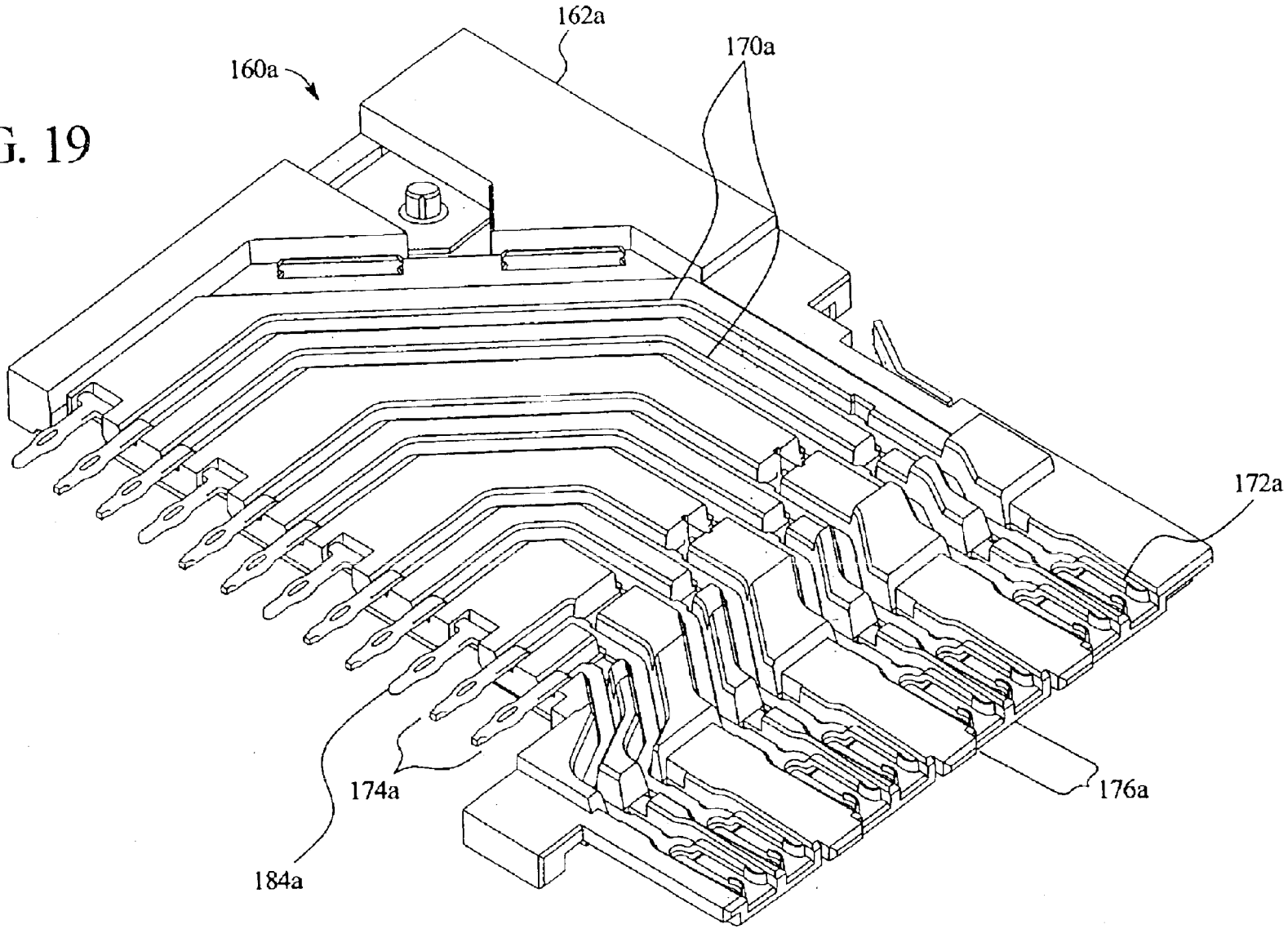
FIG. 19 illustrates an isometric view of the first contact module from the opposite side as that shown in FIG. 17 according to an alternative embodiment of the present invention.
Figure 20:
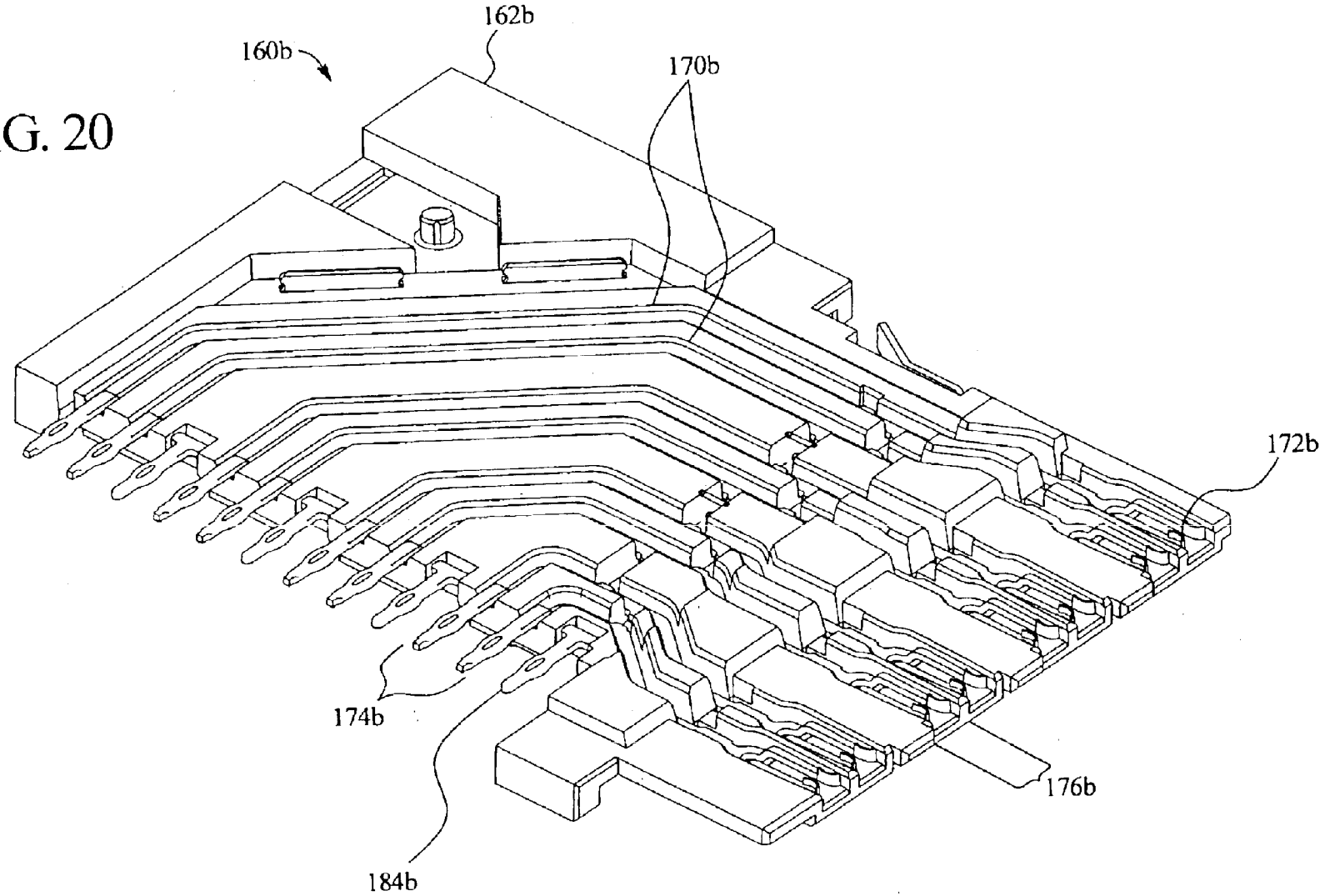
FIG. 20 illustrates an isometric view of the second contact module from the opposite side as that shown in FIG. 18 according to an alternative embodiment of the present invention.

FIG. 19 is an isometric view of the contact module 160*a* from the opposite side of that shown in FIG. 17 according to an alternative embodiment of the present invention. FIG. 20 is an isometric view of the contact module 160*b* from the opposite side of that shown in FIG. 17 according to an alternative embodiment of the present invention. Each of the contact modules 160*a*, 160*b* has a plurality of signal contacts 170*a*, 170*b*. Each signal contact 170*a*, 170*b* has a receptacle section 172*a*, 172*b* at a mating end and a compliant tail section 174*a*, 174*b* at a board-mating end. The receptacle sections 172*a*, 172*b* include dual contact beams 176*a*, 176*b*, respectively, each of which engages a corresponding signal contact post 26 that is inserted therebetween.

Figure 21:
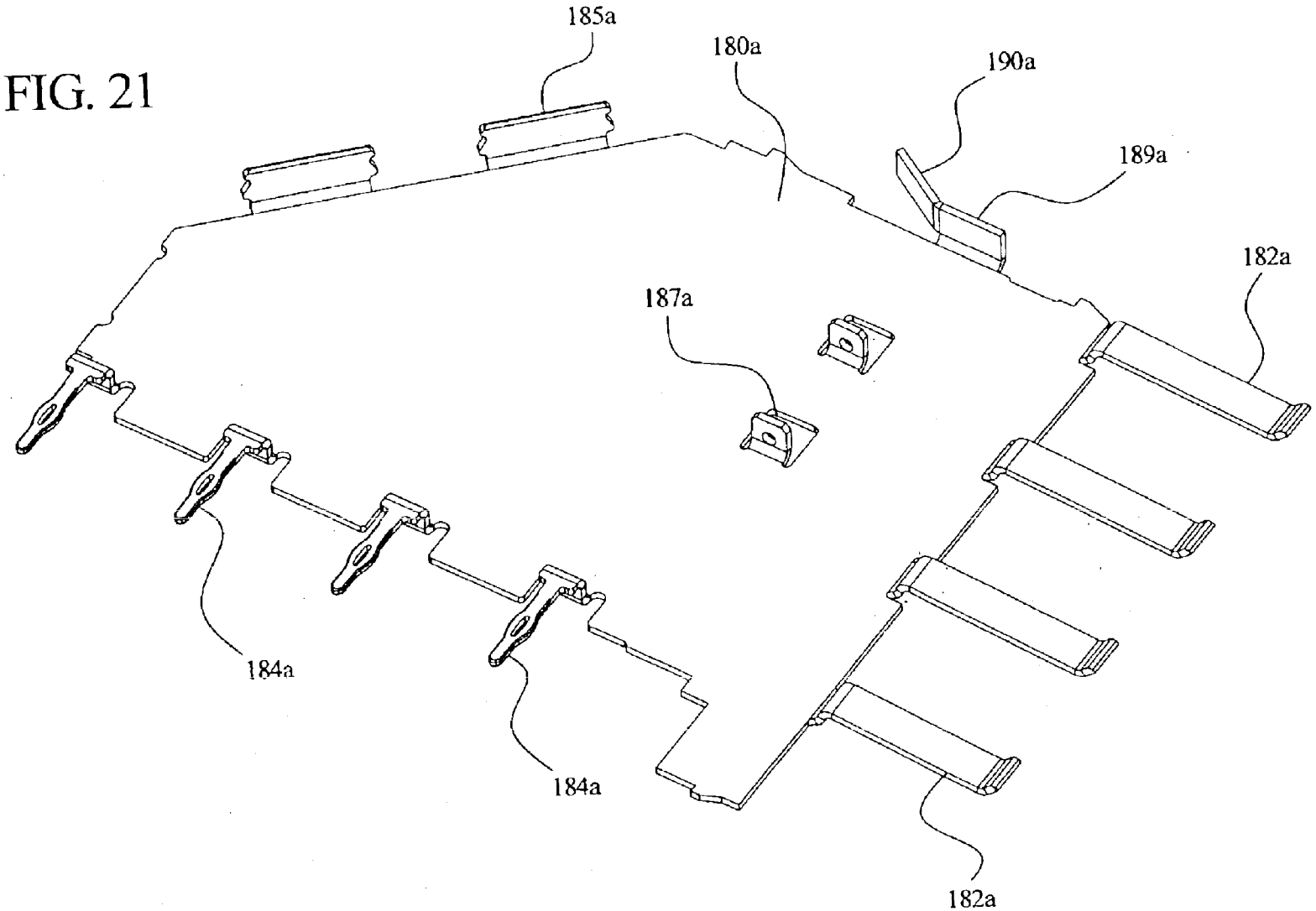
FIG. 21 illustrates an isometric view of a ground shield configured for a first contact module according to an alternative embodiment of the present invention.
Figure 22:
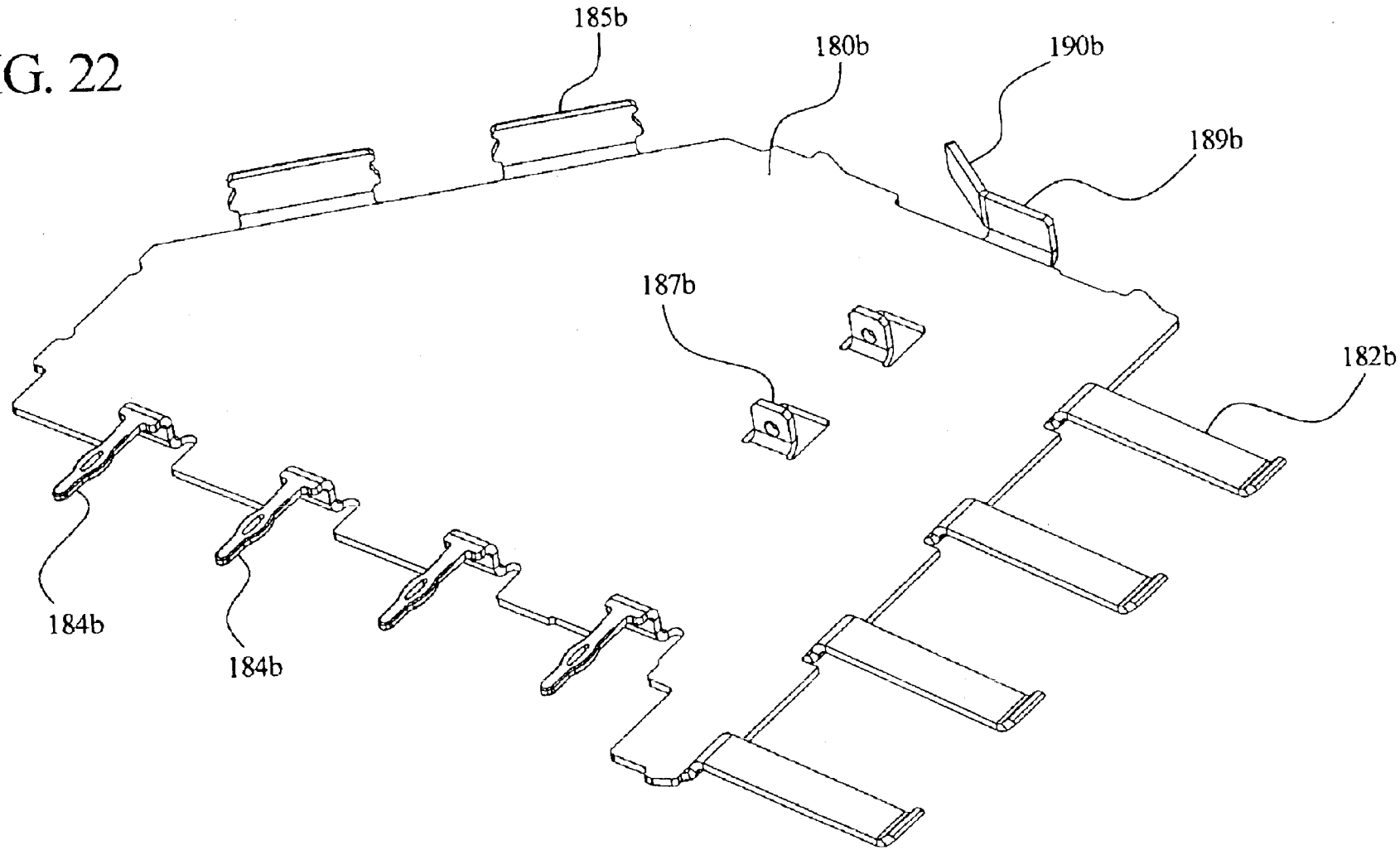
FIG. 22 illustrates an isometric view of a ground shield configured for a second contact module according to an alternative embodiment of the present invention.

FIG. 21 is an isometric view of a ground shield 180*a* configured for the contact module 160*a* according to an alternative embodiment of the present invention. FIG. 22 is an isometric view of a ground shield 180*b* configured for the contact 160*b* module according to an alternative embodiment of the present invention. As shown in FIGS. 17 and 18, each of the contact modules 160*a*, 160*b* has a ground shield 180*a*, 180*b*, respectively. Each ground shield 180*a*, 180*b* has ground contact springs 182*a*, 182*b*, respectively, which are engageable with corresponding ground contact blades 136 of the header connector 100. Additionally, each ground shield 180*a*, 180*b* has a compliant tail section 184*a*, 184*b*, respectively, for engaging ground through-holes in a circuit board (not shown). Each ground shield 180*a*, 180*b* also has a first upper barb 186*a*, 186*b*, a second upper bard 187*a*, 187*b*, and a lower barb 188*a*, 188*b*, all of which dig into the dielectric housing 152 as the contact module 160*a*, 160*b* is inserted into the receptacle housing 150 to secure the contact module 160*a*, 160*b* in the receptacle housing 150. Additionally, each ground shield 180*a*, 180*b* includes a resilient latch tab 189*a*, 189*b*, respectively, which extends from a folded portion 190*a*, 190*b*. The latch tabs 189*a*, 189*b* engage a corresponding ledge of the receptacle housing 150 to prevent the contact modules 160*a*, 160*b* from backing out of the receptacle housing 150. Additionally, the ground shields 180*a*, 180*b* include protruding members 185*a*, 187*a* and 185*b*, 187*b*, respectively, which engage corresponding features within the dielectric moldings 162*a*, 162*b*, respectively, so that the ground shields 180*a*, 180*b* may be secured within the dielectric moldings.

Each of the contact modules 160*a*, 160*b* have upper beams 164*a*, 164*b* and lower beams 168*a*, 168*b* that are receivable in corresponding tracks in the upper and lower shrouds 155 and 156, a projection 165*a*, 165*b* that may cooperate with a support on the upper shroud 155, and a lug 166*a*, 166*b* that is receivable in a groove in the lower shroud 156. The beams 164*a*, 164*b*, the projections 165*a*, 165*b* and the lugs 166*a*, 166*b* serve to stabilize and align the contact modules 160*a*, 160*b* in the receptacle housing 150.

Embodiments of the present invention are not limited to the configurations shown. For example, more or less signal and ground contacts may be used within corresponding header and receptacle connectors. That is, the header connector may include more or less rows of signal contact pairs (and associated ground compliant sections), and the receptacle connector may include a corresponding number of contact modules spaced apart according to the orientation of the rows within the header connector. Additionally, the ground contacts may be configured so that the plane of the blade is not perpendicular to the plane of the compliant section of the ground contact. For example, the ground contact may include a semi-cylindrical blade that partially encircles a signal contact pair. Alternatively, the ground contacts may also include walls that extend perpendicularly from the edges of the blade to complete enclose a signal contact pair.

Thus, embodiments of the present invention provide an electrical connector that exhibits improved signal characteristics in terms of impedance, interference, noise and jitter. Because differential pairs are shielded from one another both physically and electrically (by ground contacts), the effects of impedance, interference, noise and jitter are diminished. Embodiments of the electrical connector electrical connector may accommodate a high number of signal contacts, while minimizing interference, noise and jitter among the signal contacts, due to the staggered nature of the rows of signal contact pairs and ground contacts within the electrical connector.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector comprising:

a connector housing holding signal contacts and ground contacts in an array organized into rows, each said row including pairs of said signal contacts and some of said ground contacts arranged in a pattern, wherein adjacent first and second rows have respective different first and second patterns.

2. The electrical connector of claim 1, wherein said first and second patterns each include said signal contact pairs and said ground contacts arranged in an alternating sequence.

3. The electrical connector of claim 1, wherein each of said rows alternates between said signal contact pairs and said ground contacts so that each signal contact pair is separated from another in-row signal contact pair by a ground contact.

4. The electrical connector of claim 1, wherein adjacent rows are staggered relative to one another so that said signal contact pairs in adjacent rows are separated from one another by said ground contacts.

5. The electrical connector of claim 1, wherein a first signal contact pair in said first row is shielded from a second signal contact pair in said first row by a first ground contact, and wherein said first row is staggered with respect to said second row so that said first signal contact pair is shielded from a third signal contact pair in said second row by said first ground contact.

6. The electrical connector of claim 1, wherein an order of said ground contacts and signal contact pairs in said first pattern is reversed with respect to an order of said ground contacts and signal contact pairs in said second pattern.

7. The electrical connector of claim 1, wherein said signal contact pairs are configured to carry pairs of differential signals.

8. The electrical connector of claim 1, wherein each signal contact pair includes a pair of signal contact posts extending from said connector housing, wherein each pair of signal contact posts in said first row is staggered with respect to an adjacent pair of signal contact posts in said second row.

9. The electrical connector of claim 1, wherein each of said ground contacts comprises a compliant tail section and a blade section joined offset from one another by a bend portion, wherein said compliant tail sections shield said signal contact pairs in said first row from one another and said blade sections shield said signal contact pairs in said first and second rows from one another.

10. An electrical connector comprising:

a connector housing holding signal and ground contacts organized into contact groups, each contact group having at least two signal contacts and a single ground contact, said contact groups being aligned in parallel rows, wherein said contact groups in each of said rows are staggered with respect to said contract groups in adjacent rows, wherein each of said ground contacts has a blade section isolating said signal contacts in a corresponding contact group from signal contacts in said adjacent rows.

11. The electrical connector of claim 10, wherein said contact groups alternate between said single ground contacts and signal contact pairs such that each signal contact pair is separated from another signal contact pair by a single ground contact.

12. The electrical connector of claim 10, wherein each of said rows includes an alternating sequence of signal contact pairs and said ground contacts so that each said signal contact pair is separated from another in-row signal contact pair by a ground contact.

13. The electrical connector of claim 10, wherein adjacent rows are staggered relative to one another so that said signal contacts in adjacent rows are separated from one another by ground contacts.

14. The electrical connector of claim 10, wherein a first signal contact pair in a first row is shielded from a second signal contact pair in said first row by a first ground contact, and wherein said first row is staggered with respect to a second row so that said first signal contact pair is shielded from a third signal contact pair in said second row by said first ground contact.

15. The electrical connector of claim 10, wherein an order of said ground contacts and signal contact pairs in a first group is reversed with respect to an order of said ground contacts and signal contact pairs in a second group.

16. The electrical connector of claim 10, wherein said at least two signal contacts are configured to carry pairs of differential signals.

17. The electrical connector of claim 10, wherein each signal contact pair includes a pair of signal contact posts extending from said channels of said connector housing, wherein each pair of signal contact posts in said first row is staggered with respect to an adjacent pair of signal contact posts in said second row.

18. The electrical connector of claim 10, wherein each of said ground contacts comprises a compliant tail section and a blade section joined offset from one another by a bend portion, wherein said compliant tail sections shield signal contact pairs in a first row from one another and said blade sections shield signal contact pairs in first and second rows from one another.

19. An electrical connector comprising:

a connector housing holding signal contacts and ground contacts in an array organized into rows, each row including ground contacts separated by signal contact pairs, wherein said ground contacts and signal contact pairs are ordered in different first and second patterns, respectively, in adjacent first and second rows in said array, wherein said first and second rows are staggered relative to one another so that said signal contact pairs in said first and second rows are separated from one another by said ground contacts, and wherein a first signal contact pair in said first row is shielded from a second signal contact pair in said first row by a first ground contact, and wherein said first row is staggered with respect to said second row so that said first signal contact pair is shielded from a third signal contact pair in said second row by said first ground contact.

20. The electrical connector of claim 19, wherein each signal contact pair includes a pair of signal contact posts extending from said connector housing, wherein each pair of signal contact posts in said first row is staggered with respect to an adjacent pair of signal contact posts in said second row.

21. The electrical connector of claim 19, wherein each of said ground contacts comprises a compliant tail section and a blade section joined offset from one another by a bend portion, wherein said compliant tail sections shield said signal contact pairs in said first row from one another and said blade sections shield said signal contact pairs in said first and second rows from one another.

* * * * *